US008684955B2

(12) United States Patent
Liu et al.

(10) Patent No.: US 8,684,955 B2
(45) Date of Patent: Apr. 1, 2014

(54) BACK KNEADING DEVICE MOUNTED IN CHAIR-TYPE MASSAGE APPARATUS AND CHAIR-TYPE MASSAGE APPARATUS EQUIPPED WITH THE BACK KNEADING DEVICE

(75) Inventors: Ying Liu, Higashi-Osaka (JP); Koichi Numata, Higashi-Osaka (JP); Shinsaku Shimizu, Higashi-Osaka (JP); Fumitaka Ishiguro, Higashi-Osaka (JP)

(73) Assignee: Daito Electric Machine Industry Company Limited, Higashi-Osaka-shi, Osaka (JP)

( * ) Notice: Subject to any disclaimer, the term of this patent is extended or adjusted under 35 U.S.C. 154(b) by 596 days.

(21) Appl. No.: 13/058,441

(22) PCT Filed: Apr. 15, 2010

(86) PCT No.: PCT/JP2010/056734

§ 371 (c)(1),
(2), (4) Date: Feb. 10, 2011

(87) PCT Pub. No.: WO2011/065038

PCT Pub. Date: Jun. 3, 2011

(65) Prior Publication Data

US 2011/0275968 A1 Nov. 10, 2011

(30) Foreign Application Priority Data

Nov. 24, 2009 (JP) ..... P2009-266090
Mar. 29, 2010 (JP) ..... P2010-075366

(51) Int. Cl.
*A61H 7/00* (2006.01)

(52) U.S. Cl.
USPC ..... 601/98; 601/49; 601/86; 601/90; 601/134

(58) Field of Classification Search
CPC ..... A61H 7/00; A61H 7/007; A61H 7/008; A61H 23/006; A61H 2007/007; A61H 2007/009; A61H 2023/02
USPC ..... 601/49–54, 90–92, 98–100, 115–117
See application file for complete search history.

(56) References Cited

U.S. PATENT DOCUMENTS 7,029,453 B2 * 4/2006 Chen ..... 601/99
2003/0216674 A1 * 11/2003 Miki et al. ..... 601/99

(Continued)

FOREIGN PATENT DOCUMENTS

JP 2001-112831 A 4/2001

(Continued)

*Primary Examiner* — Justine Yu
*Assistant Examiner* — Valerie L Skorupa
(74) *Attorney, Agent, or Firm* — Birch, Stewart, Kolasch & Birch, LLP

(57) ABSTRACT

A back kneading device capable of causing a massage mechanism to protrude forward and return to an original normal position is provided with no increase in size and complexity in construction. The back kneading device mounted in a chair massage apparatus includes the massage mechanism having a pair of right-hand and left-hand massage members, a base member for pivotally supporting the mechanism at its lower end, a vertical movement mechanism for imparting a vertical motion to the base member, an advancing and retracting mechanism for rockably driving the massage mechanism, and a rock restricting mechanism for an adjusting an angle of rotation of the massage mechanism so that, when the device is in an upper position, an upper end of the massage member protrudes forward, whereas, in a lower position, a lower end thereof protrudes forward.

12 Claims, 20 Drawing Sheets

(56) References Cited

U.S. PATENT DOCUMENTS

| | | | | |
|---|---|---|---|---|
| 2004/0171972 | A1 | 9/2004 | Shimizu et al. | |
| 2005/0096571 | A1* | 5/2005 | Miki | 601/99 |
| 2007/0149907 | A1* | 6/2007 | Ting et al. | 601/99 |
| 2007/0299377 | A1* | 12/2007 | Shiraishi | 601/98 |
| 2009/0149784 | A1* | 6/2009 | Morita et al. | 601/94 |
| 2009/0149785 | A1* | 6/2009 | Canto Garcia et al. | 601/99 |

FOREIGN PATENT DOCUMENTS

| | | | |
|---|---|---|---|
| JP | 2002-360647 | A | 12/2002 |
| JP | 2003-102798 | A | 4/2003 |
| JP | 2004-41689 | A | 2/2004 |
| JP | 2005-237662 | A | 9/2005 |
| JP | 2008-104765 | A | 5/2008 |
| JP | 2008-253467 | A | 10/2008 |

* cited by examiner

BACK KNEADING DEVICE MOUNTED IN CHAIR-TYPE MASSAGE APPARATUS AND CHAIR-TYPE MASSAGE APPARATUS EQUIPPED WITH THE BACK KNEADING DEVICE

TECHNICAL FIELD

The present invention relates to a back kneading device mounted in a chair-type massage apparatus and a chair-type massage apparatus equipped with the back kneading device.

BACKGROUND ART

Where a backrest of a chair-type massage apparatus is concerned, there is a heretofore known backrest having a built-in massage mechanism for operating a pair of right-hand and left-hand massage members in a manner to give a massage. This massage mechanism needs to be designed to move so as to conform to the spine of a user sitting on a seat of the massage apparatus, wherefore a vertical movement mechanism is provided therein for such a movement. The massage mechanism and the vertical movement mechanism constitute aback kneading device.

As a back kneading device of this type, there has hitherto been proposed a device having an advancing and retracting mechanism capable of causing a massage member to protrude forward beyond a normal massage position and causing it to return to the original normal position (refer to Patent Literature 1, for example). In this advancing and retracting mechanism, a support frame, which is moved up and down in a backrest by a vertical movement mechanism, is provided independently of a massage mechanism. The massage mechanism is supported on the support frame in such a manner that its upper-end side can be rocked back and forth about a lower pivot point, and in this state the mutually corresponding upper parts of the support frame and the massage mechanism can be moved in contact with and away from each other in a front-rear direction (back-and-forth driving operation).

There are four systems that exemplify the method to effect such a contact-separation operation: "Air system" using an air cell in which switching between an expansion mode and a contraction mode is done by admission and release of air; "Link system" in which, in a threaded shaft having a right-hand thread portion and a left-hand thread portion formed divisionally in its upper and lower parts in a vertical direction, and an internal thread body is threadedly engaged with each of the upper and lower thread portions, the upper and lower internal thread bodies being coupled to each other in the form of a toggle linkage by a pair of links; "Cam system" in which an eccentric cam is rotated while being fitted in a support body with a bearing; and "Lever system" in which a link (rocking lever) is rocked through an engagement between a worm gear and a threaded gear (pinion gear).

PRIOR ART REFERENCE

Patent Literature

Patent literature 1: Japanese Unexamined Patent Publication JP-A 2003-102798

SUMMARY OF THE INVENTION

Problems to be Solved by the Invention

In the conventional chair-type massage apparatus equipped with a back kneading device, each of the four driving systems exemplified by way of the advancing and retracting mechanism poses imperfections and is thus unfavorable as a matter of practicality.

For example, in the Air system, when the air cell is expanded to cause the massage mechanism to protrude forward, the expansion force of the air cell yields to a backward pressing force exerted by a user (leaning load), with the consequence that the massage mechanism is inconveniently forced to return. This problem gives rise to a decrease of finger-pressure force (massage effect) produced by the massage mechanism, as well as to displacement of finger-pressure positions. There is also the problem of noise resulting from a flow of air, air emission sound, and so forth.

The Link system is bottlenecked on the necessity of a pair of links, and it is essential to provide a threaded shaft formed with right-hand and left-hand thread portions. This drives up costs in terms of a parts count. Furthermore, the length of the threaded shaft is so long that the size of the back kneading device as a whole is undesirably increased.

A fundamental problem that exists in the Cam system is that, since cam eccentricity cannot be secured in large amounts, it becomes impossible to impart a great back-and-forth stroke to the massage mechanism. If the amount of cam eccentricity is increased to obtain a great back-and-forth stroke, not only the back kneading device in itself but also the backrest of the chair-type massage apparatus will be larger in size (be bulky). Therefore, this system is not adoptable. Furthermore, since the cam and the support member are disposed in engaged relation to each other through the bearing, when the backward pressing force (leaning load) is exerted by a user at the time of forward protrusion of the massage mechanism, the cam and support member undergo a rotational slip. In consequence, just as is the case with the air cell, the massage mechanism is inconveniently forced to return.

In the Lever system, since the gear reduction ratio between the worm gear and the threaded gear is increased fundamentally and fatalistically, it follows that the motion of the advancing and retracting mechanism becomes very sluggish with a consequent reduction in the speed of back-and-forth movement of the massage mechanism. This leads to a disadvantage that, for example, when a series of massage steps is performed by the chair-type massage apparatus as a whole, cycle time is uselessly increased.

The present invention has been devised in view of the forgoing circumstances, and accordingly its object is to provide a back kneading device mounted in a chair-type massage apparatus characterized in that, where a configuration capable of causing a massage mechanism to protrude forward and return to an original normal position is adopted, a back-and-forth movement of the massage mechanism can be effected swiftly with a sufficiently large stroke without causing a decrease in massage effect, and there is no problem with an increase in size and complexity in construction.

Means for Solving the Problems

In order to accomplish the above object, the following technical means is adopted for the implementation of the present invention.

The back kneading device of the present invention is designed as a back kneading device which is mounted in a backrest of a chair-type massage apparatus, comprising:

a massage mechanism including a pair of right-hand and left-hand massage members each having treatment elements disposed at an upper end and a lower end thereof, respectively, and a driving section for transmitting a massage motion to the massage members;

a base member for retaining said massage mechanism for free back-and-forth rocking movement while supporting a lower-end part of the massage mechanism at a rockably pivoting portion;

a vertical movement mechanism for allowing the base member to move in a vertical direction in said backrest;

an advancing and retracting mechanism for advancing and retracting an upper-end part of said massage mechanism in a front-rear direction relative to said base member; and a rock restricting mechanism capable of holding the upper end of said massage member in a forward-protruding state when the upper-end part of the massage mechanism is caused to protrude forward by said advancing and retracting mechanism.

It is preferable that said rock restricting mechanism is configured to be able to hold the lower end of said massage member in a forward-protruding state when the upper-end part of the massage mechanism is caused to retract backward by said advancing and retracting mechanism.

It is advisable that the foregoing massage mechanism is provided with a kneading driving portion which comprises a first rotation shaft installed in alignment with a horizontal direction, the massage members disposed for free rotation relative to the first rotation shaft, and a swing preventive mechanism engaged with said massage member for restraining said massage member from rotating dependently with a rotation of the first rotation shaft, for producing a kneading action by moving the massage members closer to and away from each other through a driving rotation of the first rotation shaft, that said massage mechanism is also provided with a tapping driving portion which is coupled to said swing preventive mechanism and produces a tapping action by advancing and retracting the massage member in the front-rear direction through a to-and-fro rocking movement of said support arm about the first rotation shaft via the swing preventive mechanism, said tapping driving portion including a second rotation shaft disposed in parallel with the first rotation shaft, an eccentric driver eccentrically mounted with respect to the second rotation shaft, and a long crankshaft which has its one end coupled for reception of an eccentric rotation from said eccentric driver and has the other end coupled to said swing preventive mechanism, and is moved reciprocally in a lengthwise direction through the eccentric rotation from said eccentric driver, and that said tapping driving portion is free to move in a direction perpendicular to the first rotation shaft, or the vertical direction, and, as said tapping driving portion is moved up and down, said crankshaft is moved up and down correspondingly, thereby allowing said massage member to rotate about the first rotation shaft.

Moreover, it is preferable that said rock restricting mechanism includes a sliding member disposed at both ends of the second rotation shaft provided in said tapping driving portion coaxially with the second rotation shaft, and an endless guide rail section in which the sliding member is slidingly moved, and that, in said guide rail section, there is formed a first rotation restricting portion in which said sliding member is fitted when the upper-end part of said massage mechanism is caused to protrude forward, thereby restricting an angle of rotation of said massage member so that the upper end of said massage member can be kept in a forward-protruding state.

Moreover, it is advisable that said rock restricting mechanism includes a sliding member disposed at both ends of the second rotation shaft provided in said tapping driving portion coaxially with the second rotation shaft, and an endless guide rail section in which the sliding member is slidingly moved, and that, in said guide rail section, there is formed a second rotation restricting portion in which said sliding member is fitted when the upper-end part of said massage mechanism is caused to retract backward, thereby restricting an angle of rotation of said massage member so that the lower end of said massage member can be kept in a forward-protruding state.

Moreover, it is advisable that said rock restricting mechanism includes a sliding member disposed at both ends of the second rotation shaft provided in said tapping driving portion coaxially with the second rotation shaft, and an endless guide rail section in which the sliding member is slidingly moved, and that, in said guide rail section, there is formed a rotation permitting portion for allowing the massage member to rotate about said first rotation shaft by permitting vertical movement of said sliding member.

It is also advisable that said guide rail section is defined by a periphery of an opening which is diamond-shaped when viewed laterally, said opening having a longitudinal axis (the longitudinal axis corresponds to an elliptical major axis) pointing in the front-rear direction and a transverse axis (the transverse axis corresponds to an elliptical minor axis), which is substantially perpendicular to the longitudinal axis of said opening, pointing in the vertical direction, and that, at each of opposite edges of the opening located at a front end and a rear end, respectively, of said longitudinal axis, there is formed a semicircular part in which the sliding member can be fitted, and the front-located semicircular part constitutes the first rotation restricting portion, the rear-located semicircular part constitutes the second rotation restricting portion, and a space along said transverse axis constitutes the rotation permitting portion.

Said guide rail section may be so designed that said opening has a longitudinal axis pointing in the front-rear direction and a transverse axis, which is substantially perpendicular to the longitudinal axis of said opening, pointing in the vertical direction, and that, at each of opposite edges of the opening located at the front end and the rear end, respectively, of said longitudinal axis, there are formed a back-and-forth passage through which the sliding member is allowed to slide only in the front-rear direction while being fitted therein and a semicircular part serving as a far end of the back-and-forth passage, and the front-located semicircular part constitutes the first rotation restricting portion, the front-located passage lying between the first rotation restricting portion and said opening constitutes a first protrusion adjustment portion, the rear-located semicircular part constitutes the second rotation restricting portion, the rear-located passage lying between the second rotation restricting portion and said opening constitutes a second protrusion adjustment portion, and a space along said transverse axis constitutes the rotation permitting portion.

Meanwhile, it is advisable that said advancing and retracting mechanism comprises a slider disposed for free vertical movement with respect to said base member, a slide mechanism for imparting vertical motion to the slider, a transmission arm pivotally supported for free rotation with respect to the upper-end part of said massage mechanism and said slider, for coupling said slider and the massage mechanism, a rail portion formed so as to extend forward from said base member along a lateral side of the massage mechanism, and a sliding member formed so as to extend from said massage mechanism toward the rail portion for free movement along said rail portion.

Moreover, it is advisable that said rail portion is defined by an upwardly curved arc whose center coincides with said rockably pivoting portion.

Moreover, it is advisable that a position of placement of the sliding member with respect to said massage mechanism and a pivot shaft on which said transmission arm is pivotally supported by the massage mechanism are arranged coaxially with each other on the axis of this pivot shaft.

It is advisable that said slide mechanism comprises an internal thread portion formed in said slider so as to pass therethrough in the vertical direction, a feed screw shaft threadedly engaged with the internal thread portion, and an electric motor for rotatably driving the feed screw shaft.

It is extremely desirable to construct a chair-type massage apparatus composed of a seat and a backrest which is disposed at the rear of the seat and has the foregoing built-in back kneading device.

Advantageous Effect of the Invention

In the back kneading device pursuant to the present invention, where a configuration capable of causing a massage mechanism to protrude forward and return to an original normal position is adopted, a back-and-forth movement of the massage mechanism can be effected swiftly with a sufficiently large stroke without causing a decrease in massage effect, and there is no problem with an increase in size and complexity in construction.

MODES FOR CARRYING OUT THE INVENTION

Hereinafter, embodiments of the present invention will be described with reference to the drawings.

First Embodiment

In FIGS. 1 through 13, there is shown a first embodiment of a chair-type massage apparatus equipped with a back kneading device pursuant to the present invention.

Figure 13:
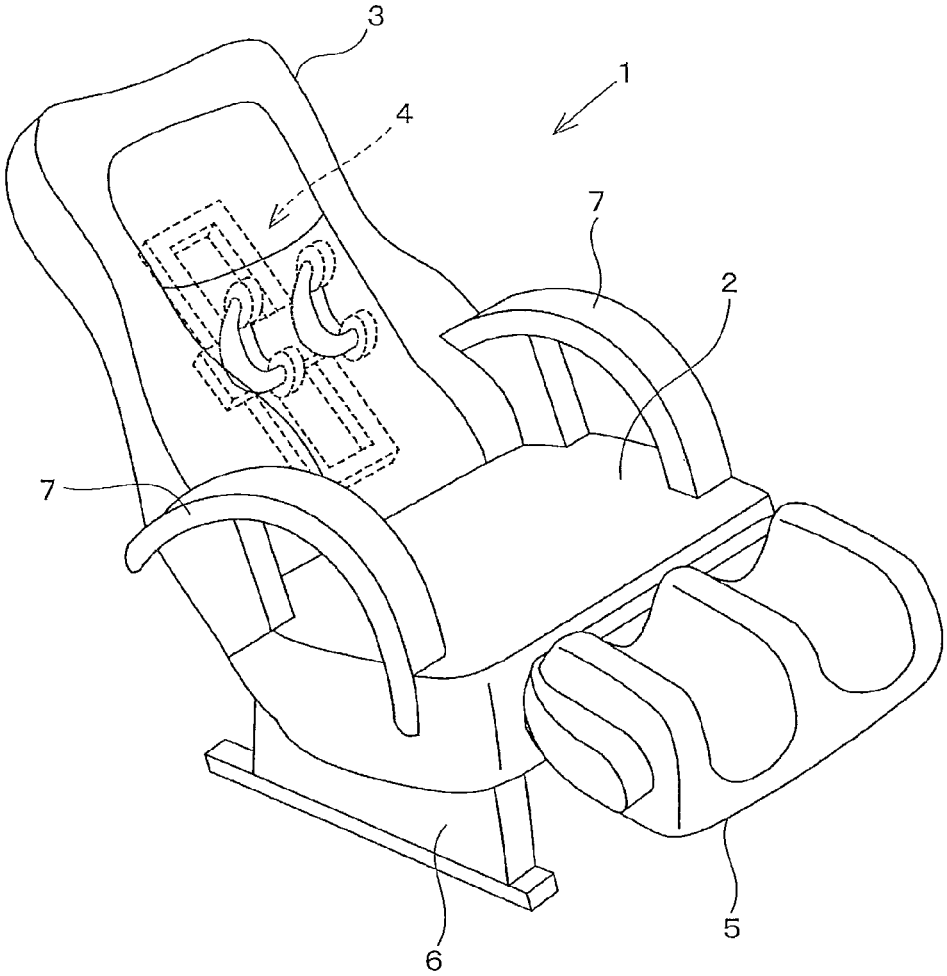
FIG. 13 is a perspective view showing a chair-type massage apparatus equipped with the back kneading device pursuant to the present invention.

As shown in FIG. 13, the chair-type massage apparatus 1 comprises a seat 2 having an area wide enough to support the buttocks of a user from below and a backrest 3 mounted at the rear of the seat 2. In addition, a back kneading device 4 (a massage device for performing a kneading or tapping massage throughout the back of a user from the shoulders to the waist) is attached to the backrest 3 interiorly thereof.

Disposed below the seat 2 is a leg frame 6 for the placement of the chair-type massage apparatus 1 on a floor. The seat 2 is supported at a predetermined level by the leg frame 6.

It is noted that, in the following description, where the backrest 3 and the back kneading device 4 are concerned, a direction of the height of the backrest 3 will be referred to as a vertical direction. Other directions such as a horizontal direction and a front-rear direction are determined on the basis of this vertical direction for the sake of explanation of structure. For example, in FIGS. 1 and 2, a direction of from top to bottom (bottom to top) of the drawing will be referred to as the vertical direction of the apparatus under actual conditions. Moreover, in FIGS. 1 and 2, a direction of drilling through the paper bearing the drawing will be referred to as the horizontal direction or widthwise direction of the apparatus under actual conditions, and a direction of from right to left of FIGS. 1 and 2 will be referred to as the front-rear direction of the apparatus under actual conditions. In FIGS. 1, 3, 6, and 12, as employed in this embodiment, the vertical direction, the horizontal direction, and the front-rear direction are specified by the terms "top and bottom", "right and left", and "front and rear", respectively.

The backrest 3 is, at its lower end, pivotally supported on the rear part of the seat 2 or the rear part of the leg frame 6 so as to be retained for free back-and-forth rocking movement. The backrest 3 can be brought into a reclining state by a reclining mechanism such as a linear actuator mechanism mounted in the leg frame 6. Moreover, a leg kneading device 5 is disposed on the front side of the seat 2, and also an armrest 7 is disposed on each of the right side and left side of the seat 2. However, such a constituent component is cited by way of example and thus there is no particular limitation to the presence or absence thereof and the details of its structure.

As shown in FIGS. 1 to 5, the back kneading device 4 comprises a massage mechanism 10, a base member 12 for supporting the lower-end part of the massage mechanism 10 via a rockably pivoting portion 11, and a vertical movement mechanism 13 for allowing the base member 12 to move up and down vertically in the backrest 3. Also provided in the back kneading device 4 are an advancing and retracting mechanism 14 that changes the angle of inclination of the massage mechanism 10 in the front-rear direction by moving the upper-end part of the massage mechanism 10 forward and backward relative to the base member 12, and a rock restricting mechanism 15 for regulating rotation or rocking movement of a massage member 17 disposed in the massage mechanism 10.

To begin with, the massage mechanism 10 will be explained with reference mainly to FIGS. 6 and 7.

The massage mechanism 10 comprises a pair of right-hand and left-hand massage members 17 and a driving section 18 for operating the right-hand and left-hand massage members 17 in a manner to give a massage properly.

The massage member 17 includes a boomerang-like support arm 20 with its extremities extended obliquely upwardly and obliquely downwardly, respectively, in a frontward direction, and a massage element 21 (treatment element) disposed at each of the upper and lower extremities of the support arm 20. Each massage element 21 can be made for example from a resin or hard rubber in the form of a thick-walled circular plate, a ball, or the like. It is noted that, in the following description, the massage element 21 at the upper extremity will be termed "upper massage element 21*a*" and the massage element 21 at the lower extremity will be termed "lower massage element 21*b*" on an as needed basis.

The driving section 18 includes a kneading driving portion 23 for operating the right-hand and left-hand massage members 17 in a manner to move closer to and away from each other and a tapping driving portion 24 for operating the right-hand and left-hand massage members 17 in a manner to perform tapping in alternate order.

The kneading driving portion 23 includes: an inclined rotating member 25 disposed in an embedded state at a central bent part of the support arm 20 of the massage member 17; a first rotation shaft 26 installed, with its axis pointing in the horizontal direction, so as to pass through the inclined rotating member 25; a kneading motor 27 (refer to FIGS. 1 and 2) for rotatably driving the first rotation shaft 26; and a swing preventive mechanism 28 disposed at the rear of the central bent part of the support arm 20, for restraining the support arm 20 from rotating dependently with the rotation of the first rotation shaft 26. For example, a universal coupling such as a ball joint and a universal joint can be used for the swing preventive mechanism 28.

The inclined rotating member 25 is fitted about a mounting boss portion, which is attached concentrically to the first rotation shaft 26 in an inclined state for unitary rotation, via a bearing in a freely rotatable fashion. Therefore, as the first rotation shaft 26 is rotated by the driving action of the kneading motor 27, the inclined rotating member 25 is swung to rotate with wobbling about the center of rotation of the first rotation shaft 26, and the resultant swingy rotation is transmitted through the support arm 20 to the massage element 21.

The support arm 20 is kept restrained against dependent rotation with the first rotation shaft 26 by the swing preventive mechanism 28 while given freedom of movement along the front-rear direction, the horizontal direction, and the vertical direction only within a predetermined range. Moreover, in a region between the right-hand and left-hand support arms 20, the direction of inclination of the inclined rotating member 25 is maintained with a phase difference of 180° with respect to the circumference of the first rotation shaft 26.

Thus, in the kneading driving portion 23, the right-hand and left-hand support arms 20 are operated in such a manner that their upper massage elements 21*a* act to repeat a cycle of mutual approach movement and separation movement in the horizontal direction and their lower massage elements 21*b* act to repeat a cycle of separation movement and mutual approach movement in the horizontal direction. More specifically, when the upper massage elements 21*a* move closer to each other, the lower massage elements 21*b* move away from each other, and, when the upper massage elements 21*a* move away from each other, the lower massage elements 21*b* move closer to each other. This operation produces a kneading action of the massage member 17.

On the other hand, the tapping driving portion 24 includes: a second rotation shaft 31 disposed above the first rotation shaft 26 of the inclined rotating member 25, with its axis pointing in the horizontal direction, so as to be in parallel with the first rotation shaft 26; a tapping motor 32 for rotatably driving the second rotation shaft 31; right-hand and left-hand eccentric drivers 34 eccentrically mounted with respect to the right-hand and left-hand ends of the second rotation shaft 31 with a phase difference of 180°; and a link lever 36 (long crankshaft) disposed so as to extend downward with respect to a housing 35 for rotatably clutching the right-hand and left-hand eccentric drivers 34.

The eccentric driver 34 is constructed by attaching an eccentric collar to an inner-ring side or outer-ring side of a bearing, for yielding a nonconformity between the axis of the second rotation shaft 31 and the axis of the housing 35. Moreover, the link lever 36 has its lower end coupled to the central bent part of the support arm 20 provided in the massage member 17, and this area of juncture between the link lever and the support arm constitutes the foregoing swing preventive mechanism 28 (such as a ball joint). That is, the swing preventive mechanism 28 is located at the lower end of the link lever 36, and the base end of the support arm 20 is connected, through the swing preventive mechanism 28, to the link lever.

Accordingly, in the tapping driving portion 24, upon the tapping motor 32 being actuated, the eccentric driver 34 is rotated eccentrically with respect to the axis of the second rotation shaft 31, and correspondingly the housing 35 is moved circumferentially. In consequence a vertically push-pull motion is transmitted from the housing 35 to the link lever 36 (long crankshaft). In this way, the right-hand and left-hand support arms 20 are operated in such a manner that their massage elements 21 wiggle about the first rotation shaft 26, and that the upper massage element 21*a* and the lower massage element 21*b* are oppositely moved in the front-rear direction. This operation produces a tapping action of the massage member 17.

It is noted that the rocking movement of the right-hand support arm 20 and the rocking movement of the left-hand support arm 20 occur in alternate order. This is because the right-hand and left-hand eccentric drivers 34 are arranged with a phase difference of 180°. That is, when the left-hand support arm 20 is so operated that its upper massage element 21*a* moves forward, then the right-hand support arm 20 is so operated that its upper massage element 21*a* moves backward. On the other hand, when the left-hand support arm 20 is so operated that its lower massage element 21*b* moves forward, then the right-hand support arm 20 is so operated that its lower massage element 21*b* moves backward.

However, it is to be understood that the foregoing operation is not to be construed as limitation. For example, by providing an appropriate switching mechanism capable of adjusting the difference in phase between the right-hand and left-hand eccentric drivers 34 to zero, it is possible to make changes to the setting of tapping action (tapping pattern) so that the right-hand and left-hand support arms 20 can be rocked in synchronization with each other in the same direction.

It is noted that, as shown in FIGS. 1 and 2 or FIGS. 6 and 7, in a location where a rotatably driving force is transmitted from the tapping motor 32 to the second rotation shaft 31, there is disposed a motor support 37 for the tapping motor 32 as a structure having a built-in reduction gear. In the motor support 37, two guide bars 38 are arranged in spaced parallel relation to each other, with their lengthwise direction aligned with the vertical direction, so as to pass therethrough as if to be put on skewer.

The guide bars 38 are installed within the framework of a guide frame 40 having a concavely curved cross section when viewed laterally. The guide frame 40 is fixedly formed so as to extend upward from a support (base) which is a gear head 39 with a built-in reduction gear for transmission of a rotatably driving force from the kneading motor 27 of the kneading driving portion 23 to the first rotation shaft 26.

That is, the tapping motor 32 is retained for free vertical movement along the guide bar 38 (in a direction in which the tapping motor 32 moves closer to and away from the kneading motor 27). As employed herein, the guide bar 38 and the guide frame 40 constitute a vertical guide support section 41 for holding the tapping driving portion 24 for free vertical movement.

The provision of such a vertical guide support section 41 allows the following movement. That is, at the time the kneading motor 27 causes the first rotation shaft 26 to rotate, as well as at the time the tapping motor 32 causes the second rotation shaft 31 to rotate, as a general rule, the massage member 17 is restrained from rotating dependently with the rotation of the first rotation shaft 26 by the swing preventive mechanism 28.

However, for example, when a leaning load exerted by a user is placed on the massage member 17, the tapping motor 32 is moved up and down in conjunction with the swing preventive mechanism 28, the link lever 36, the second rotation shaft 31, the motor support 37, and so forth that are in coupled relation to the tapping motor 32. In this case, the massage member 17 is allowed to rotate or rock about the first rotation shaft 26 only within a predetermined range.

In this construction, irrespective of whether the current massage action is produced by the kneading driving portion 23 or the tapping driving portion 24, the massage member 17 is rotated about the first rotation shaft 26 so as to conform to a curve of the back of a user like the letter S, so that the massage elements 21 abut on the back at substantially uniform pressure. The construction may be configured to be selectable between a mode of operating only one of the kneading driving portion 23 and the tapping driving portion 24 and a mode of operating both of them at the same time.

Figure 1:
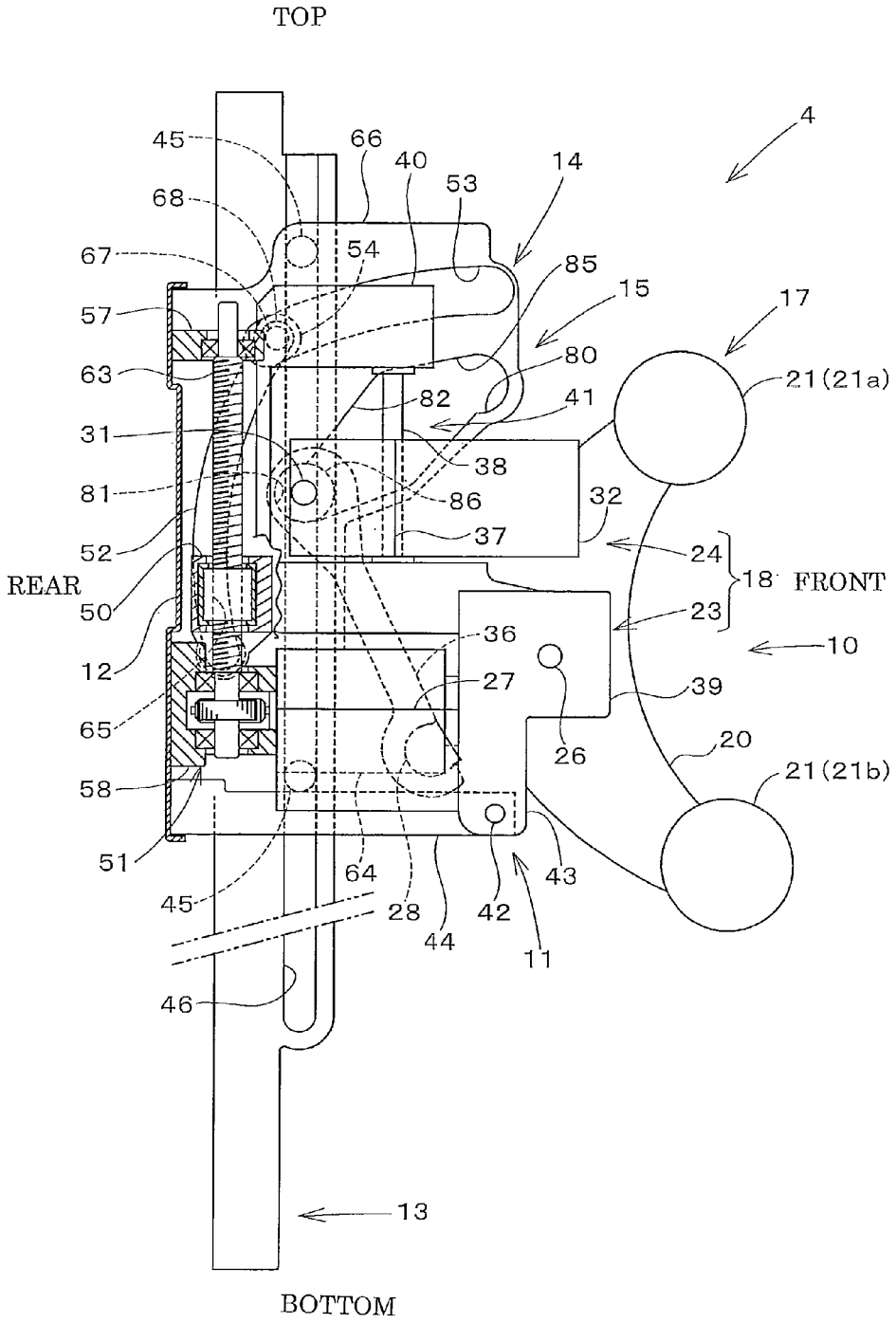
FIG. 1 is a schematic cross-sectional view of a first embodiment, illustrating a back kneading device with its massage mechanism brought into a backward-retracted state by an advancing and retracting mechanism.
Figure 2:
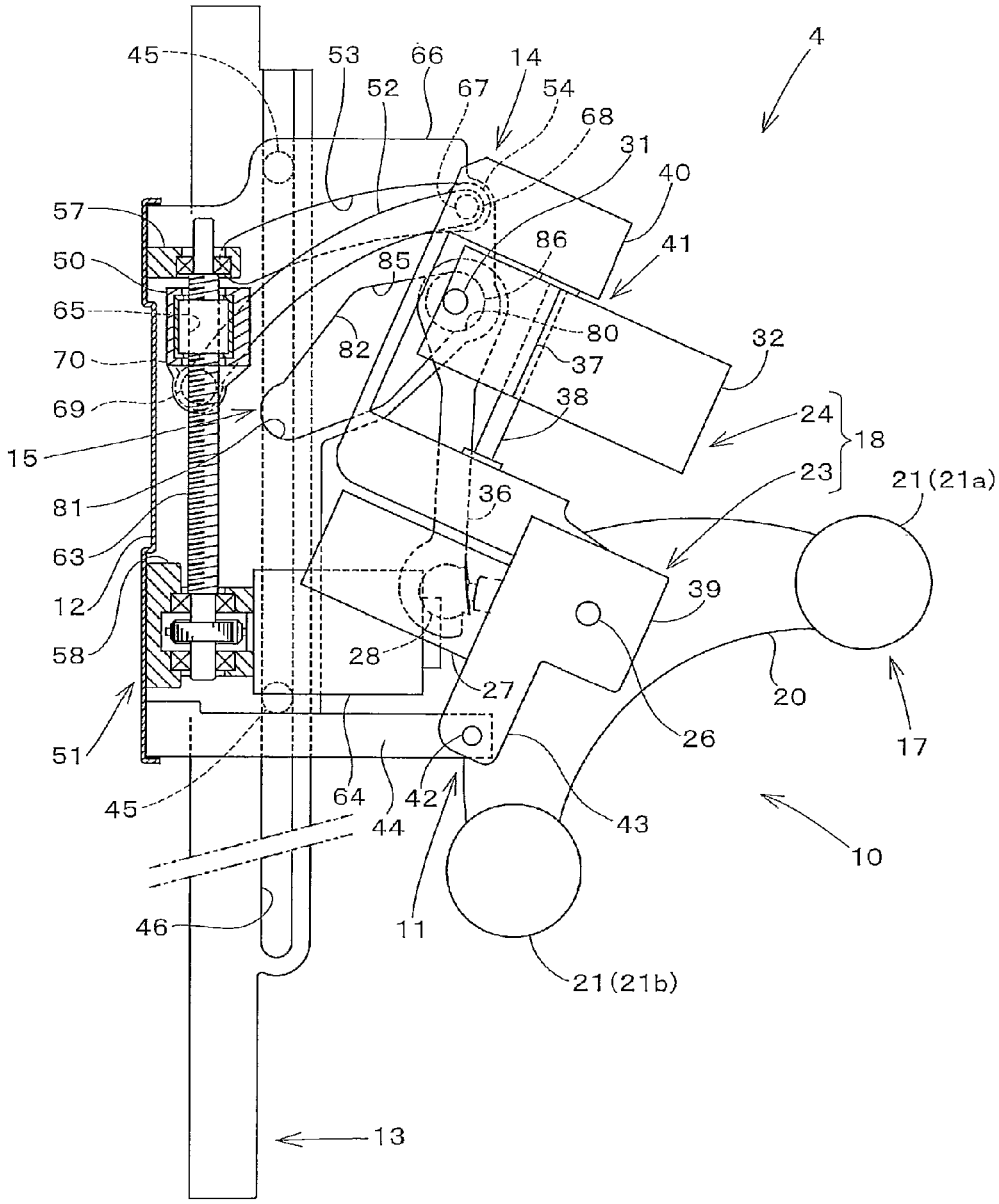
FIG. 2 is a schematic cross-sectional view of the first embodiment, illustrating the back kneading device with its massage mechanism brought into a forward-protruding state by the advancing and retracting mechanism.

The massage mechanism 10 having the foregoing structure is, at its lower-end part, supported on the aforestated base member 12 via the rockably pivoting portion 11 (refer to FIGS. 1 and 2). The rockably pivoting portion 11 has a pivot shaft 42 whose axis is pointing in the horizontal direction. The massage mechanism 10 is carried on the pivot shaft 42 acting as a fulcrum, with its upper-end part held for free back-and-forth rocking movement with respect to the base member 12.

In addition, in the first embodiment, as shown in FIGS. 1 and 2, the gear head 39 of the kneading motor 27 is provided with a downwardly protruding hinge segment 43, and there is disposed a hinge base 44 extending forward from the lower end of the base member 12 so as to support the hinge segment 43 from the right and left in sandwich style. The pivot shaft 42 is so formed as to pass through the hinge segment 43 and the hinge base 44 in the horizontal direction.

The vertical movement mechanism 13 is configured to move the massage mechanism 10 with the base member 12 and all in the vertical direction. In each of an upper part and a lower part of the base member 12, a guide roller 45 is disposed at both of the right and left sides of the part, with its axis of rotation pointing in the horizontal direction. Those guide rollers 45 are guided for free vertical movement along a pair of right-hand and left-hand guide rails 46 mounted inside the backrest 3, with their lengthwise direction pointing in the vertical direction.

Figure 3:
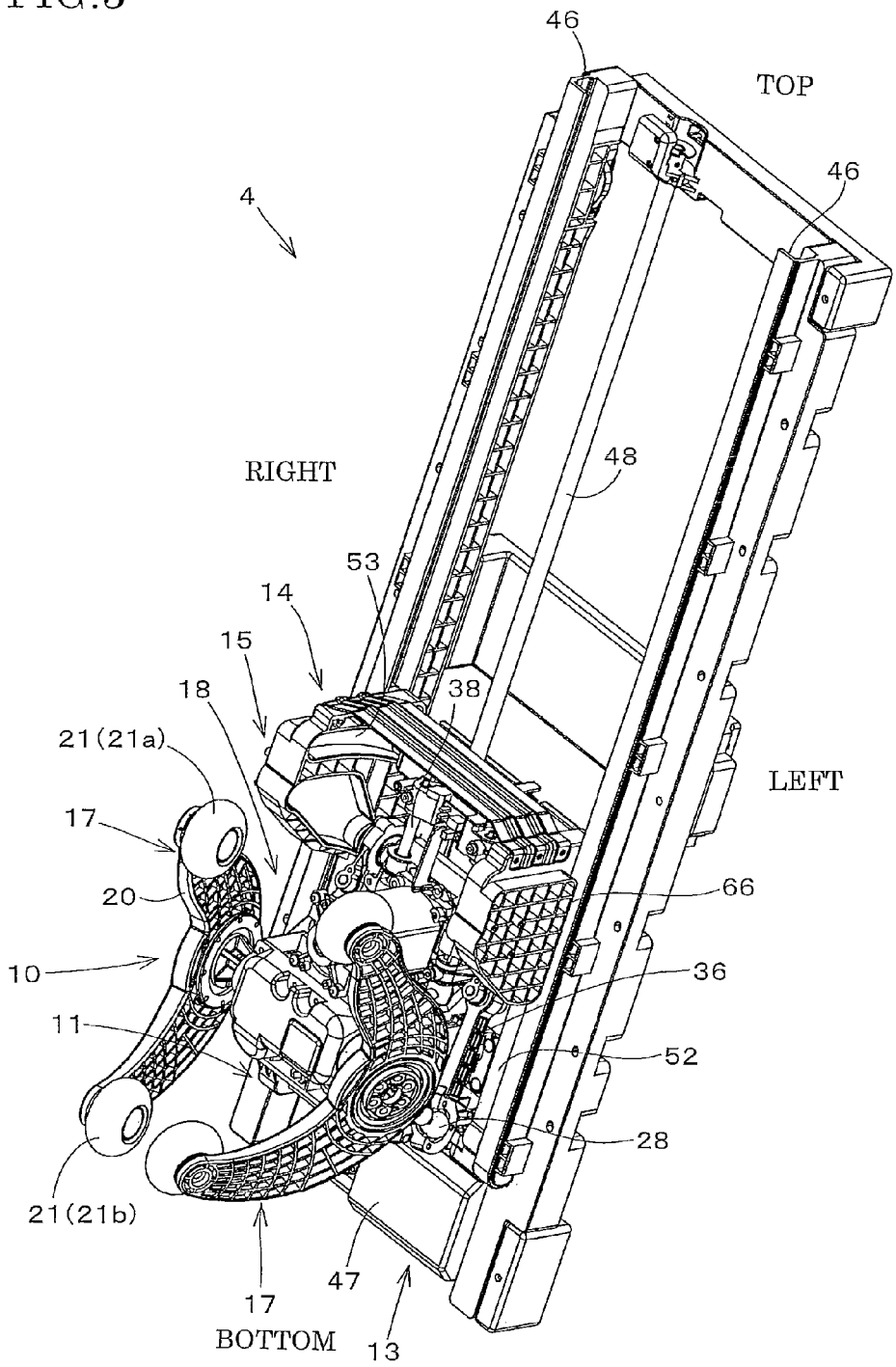
FIG. 3 is a perspective view of the first embodiment, illustrating the back kneading device with its massage mechanism brought to a lower position by a vertical movement mechanism.
Figure 4:
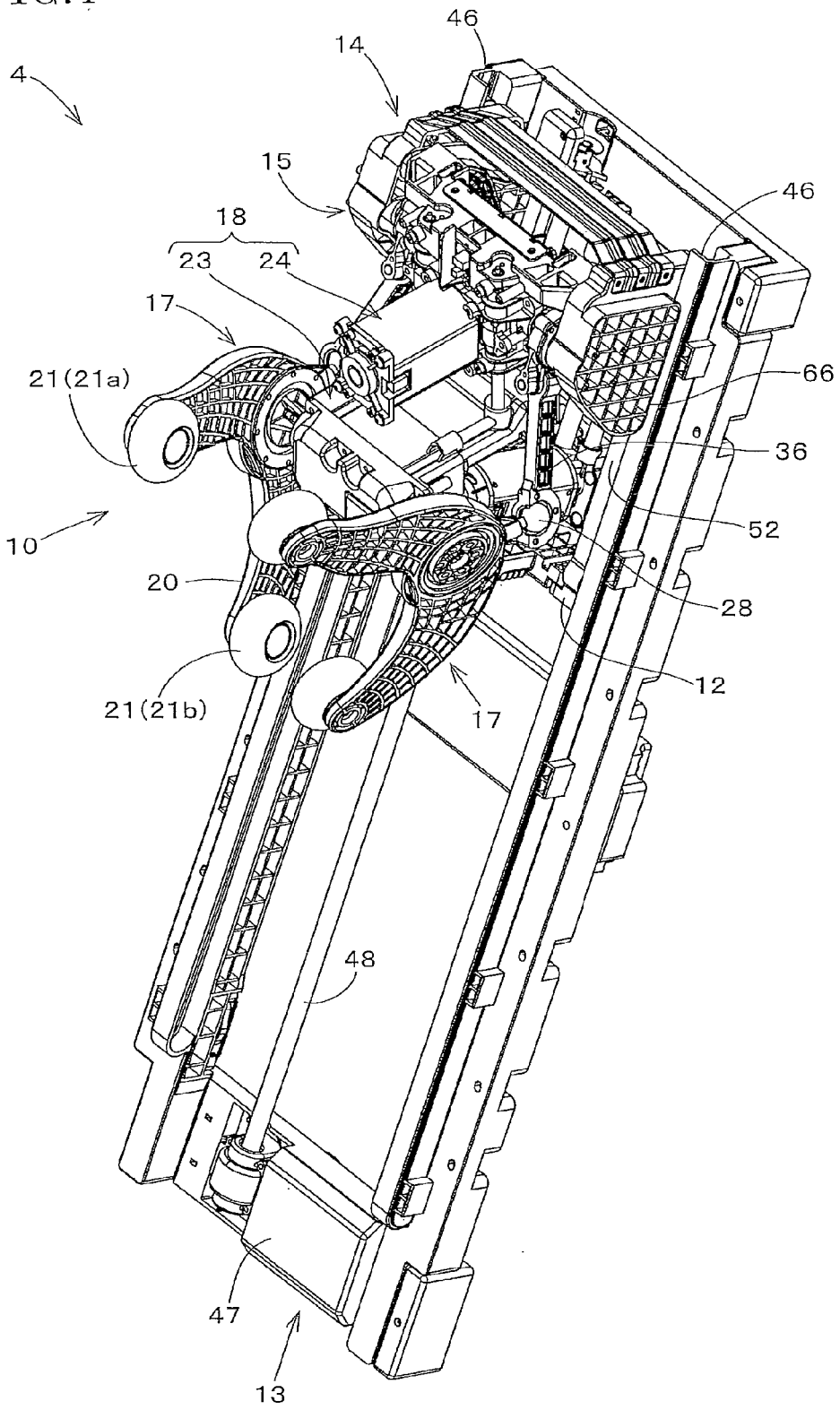
FIG. 4 is a perspective view of the first embodiment, illustrating the back kneading device with its massage mechanism brought to an upper position by the vertical movement mechanism.
Figure 5:
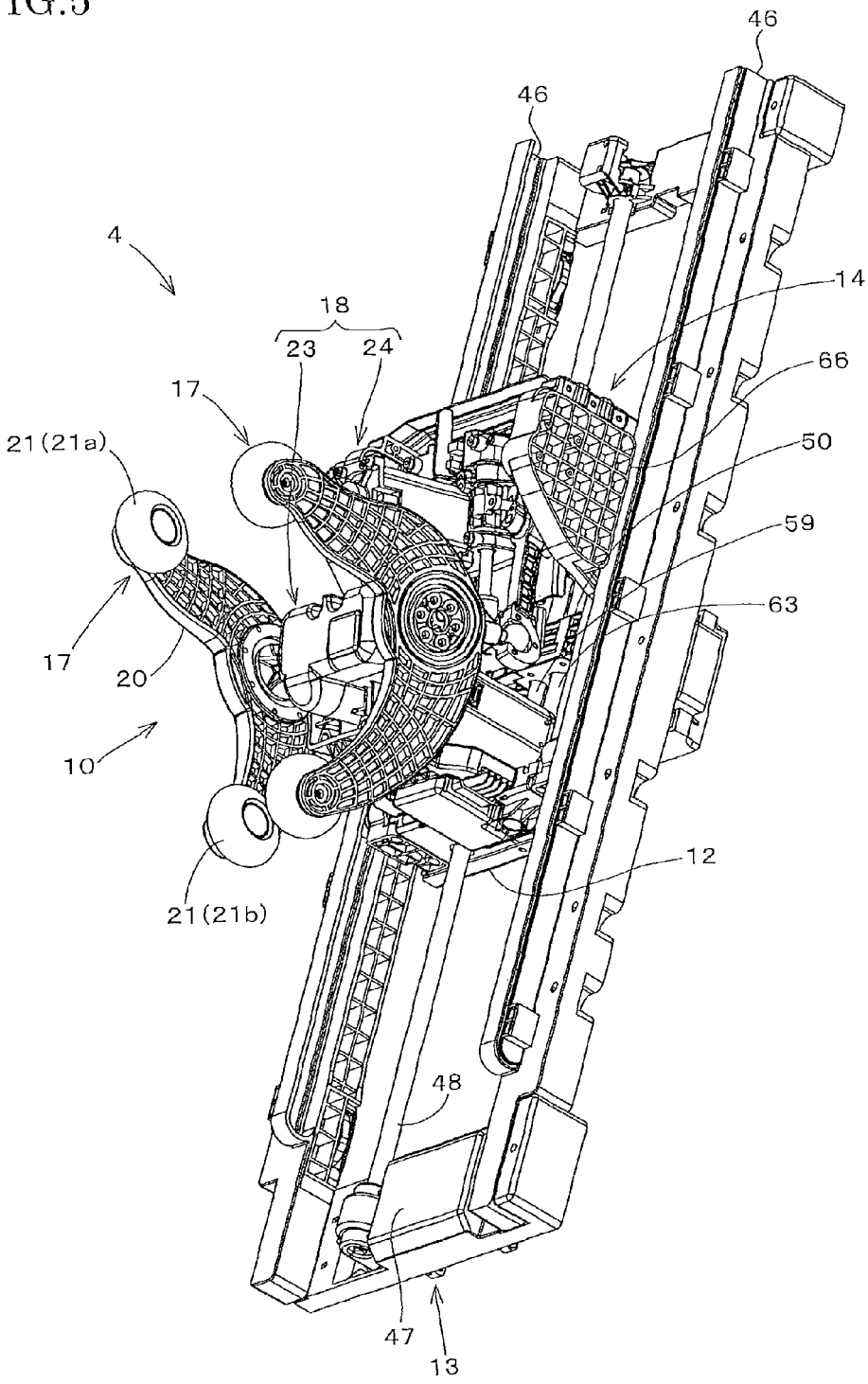
FIG. 5 is a perspective view of the first embodiment, illustrating the back kneading device with its massage mechanism brought to a position midway between the upper and lower positions in a vertical direction by the vertical movement mechanism.

Moreover, as shown in FIGS. 3 to 5, in a region between the guide rails 46, there is disposed a screw shaft 48 which is rotatably driven by a raising-lowering motor 47. The base member 12 has a built-in nut member 49 which is threadedly engaged with the screw shaft 48 (refer to FIGS. 8 to 11). Therefore, as the screw shaft 48 is rotatably driven by the action of the raising-lowering motor 47, the massage mechanism 10 is, in conjunction with the base member 12, moved up and down within the backrest 3.

In this way, a user sitting on the seat 2 with his/her back pressed against the backrest 3 is able to have a massage over a wide area including his/her shoulders, back, and waist.

Next, referring mainly to FIGS. 1 and 2, "the advancing and retracting mechanism 14" and "the rock restricting mechanism 15" will be explained that are distinctive workings provided in the chair-type massage apparatus 1 pursuant to the present invention.

Figure 6:
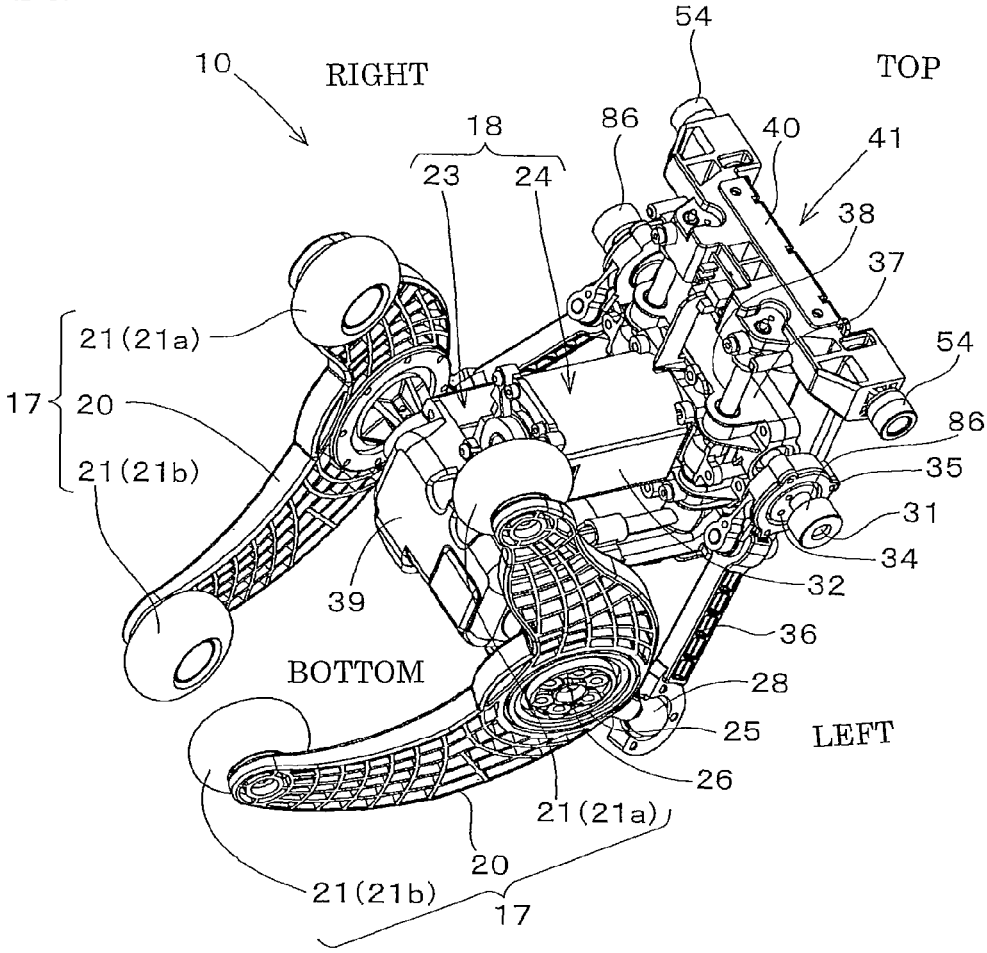
FIG. 6 is a perspective view of the first embodiment, illustrating only the massage mechanism assuming the lower position.
Figure 7:
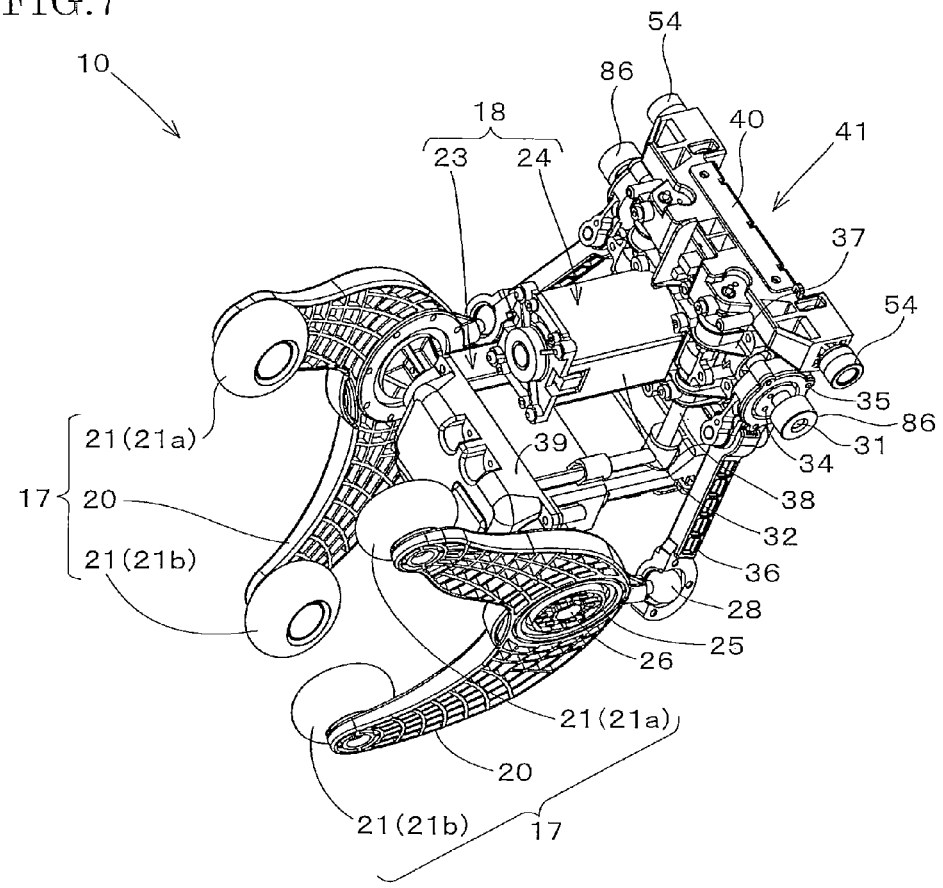
FIG. 7 is a perspective view of the first embodiment, illustrating only the massage mechanism assuming the upper position.

The advancing and retracting mechanism 14 comprises: a slider 50 disposed for free vertical movement with respect to the base member 12; a slide mechanism 51 for imparting vertical motion to the slider 50; a transmission arm 52 for coupling the slider 50 and the massage mechanism 10; a rail portion 53 disposed in the base member 12; and a sliding member 54 disposed so as to extend from the massage mechanism 10 toward the rail portion 53 (refer to FIGS. 6 and 7).

The slider 50 is disposed on the front side of the base member 12 and has the form of a pillar-like block elongated in the horizontal direction (refer to FIG. 5). In order to allow the slider 50 to move up and down with respect to the base member 12, there is provided a guide bar 59 (refer to FIG. 5) installed vertically between an upper bracket 57 disposed so as to extend forward from an upper part of the front of the base member 12 and a lower bracket 58 disposed so as to extend forward from a lower part of the front of the base member 12, through which the slider 50 passes as if to be put on skewer.

On the other hand, the slide mechanism 51 includes a feed screw shaft 63 rotatably installed between the upper bracket 57 and the lower bracket 58 in the vertical direction so as to be parallel to the guide bar 59 for the slider 50, and an electric motor 64 for rotatably driving this feed screw shaft 63. The feed screw shaft 63 passes through the slider 50 in the vertical direction, and the slider 50 is formed with an internal thread portion 65 which is threadedly engaged with the feed screw shaft 63. The structure of threadable engagement between the internal thread portion 65 and the feed screw shaft 63 is formed of a square thread which is excellent in terms of screw thrust force and anti-backlash property, or more preferably of a trapezoidal thread.

The rail portion 53 is disposed on the opposing inner surfaces of lateral plate portions 66 extending forward from the right side and the left side, respectively, of the base member 12. In the first embodiment, the rail portion 53 is illustrated as being recessed like a groove in the lateral plate portion 66. The rail portion 53 is configured to have the shape of an upwardly curved arc whose center coincides with the rockably pivoting portion 11, about which the lower-end part of the massage mechanism 10 is rockably supported by the base member 12.

The sliding member 54 is constructed of a freely rotatable roller which is slidably engaged (fitted) in the rail portion 53 (groove). Accordingly, when the massage mechanism 10 is subjected to an external force tending to rock it about the rockably pivoting portion 11, the sliding member 54 is moved arcuately along the rail portion 53, thereby bringing the rocking movement of the massage mechanism 10 into a condition of stability.

There is provided a pair (two pieces) of right-hand and left-hand transmission arms 52 that are assigned to the right side and the left side, respectively, of the massage mechanism 10 and thus the slider 50. Each of the transmission arms 52 has a first pivot shaft 67 whose axis is pointing in the horizontal direction formed in that part thereof which is connected to the massage mechanism 10. Moreover, there is formed a link coupling portion 68 which is free to rock about the first pivot shaft 67. The link coupling portion 68 is placed at the upper-end part of the massage mechanism 10.

It is noted that the position of placement of the sliding member 54 with respect to the massage mechanism 10 (the center of rotation of the roller) and the link coupling portion 68 provided in the transmission arm 52 at the side of the massage mechanism 10 are arranged in uniaxial relation to each other on the axis of the first pivot shaft 67 of the link coupling portion 68. Therefore a push-pull force transmitted to the massage mechanism 10 through the transmission arm 52 can be transmitted also to the sliding member 54 efficiently, with the consequence that the sliding member 54 is allowed to move along the rail portion 53 smoothly.

In that part of the transmission arm 52 which is connected to the slider 50, there is disposed a second pivot shaft 69 whose axis is pointing in the horizontal direction (shown only in FIG. 2), and also a link coupling portion 70 is formed that is free to rock about the second pivot shaft 69.

In the advancing and retracting mechanism 14 thereby constructed, as the feed screw shaft 63 is rotatably driven by the electric motor 64 of the slide mechanism 51, a force of upward movement or a force of downward movement is imparted to the slider 50 through the internal thread portion 65 threadedly engaged with the feed screw shaft 63. This allows the slider 50 to move upward or downward along the guide bar 59 of the slide mechanism 51.

When the slider 50 is moved upward, as shown in FIG. 2, the transmission arm 52 is actuated to force the sliding member 54 to move forward along the rail portion 53, thereby allowing the massage mechanism 10 to rock about the rockably pivoting portion 11 so as to protrude forward. Correspondingly, the right-hand and left-hand massage members 17 jut out forward.

In contrast, when the electric motor 64 of the slide mechanism 51 is driven in reverse, as shown in FIG. 1, the slider 50 is moved downward via the internal thread portion 65 threadedly engaged with the feed screw shaft 63. At this time, the transmission arm 52 is actuated to force the sliding member 54 to return backward along the rail portion 53, thereby allowing the massage mechanism 10 to rock about the rockably pivoting portion 11 so as to return to its original condition (move backward). Correspondingly, the right-hand and left-hand massage members 17 are returned to their original condition (move backward).

Meanwhile, the rock restricting mechanism 15 is a system which is added to the advancing and retracting mechanism 14 for conjoint operation therewith. The rock restricting mechanism 15 has the capability of partly restricting the rotation or rocking movement of the massage member 17 about the first rotation shaft 26 developed by the vertical guide support section 41 when the massage mechanism 10 is tilted forward or retracted in upright position.

The rock restricting mechanism 15 is provided with a first rotation restricting portion 80 for restricting the rotation (rotation about the first rotation shaft 26) of the support arm 20 in a location where the upper massage element 21*a* is jutted to assume a forwardmost position and the lower massage element 21*b* is retracted to assume a rearmost position. The rock restricting mechanism 15 is also provided with a second rotation restricting portion 81 for restricting the rotation of the support arm 20 in a location where the upper massage element 21*a* is retracted to assume a rearmost position and the lower massage element 21*b* is jutted to assume a forwardmost position.

Moreover, the rock restricting mechanism 15 includes a rotation permitting portion 82 for permitting the rotation (rotation about the first rotation shaft 26) of the massage member 17 so long as the massage member 17 (the support arm 20) assumes positions other than the positions at which it is restrained against rotation by the first rotation restricting portion 80 and the second rotation restricting portion 81.

The first rotation restricting portion 80, the second rotation restricting portion 81, and the rotation permitting portion 82 are each assigned a predetermined area of a guide rail section 85 disposed at the side of the base member 12, and play their own roles when a roller-like sliding member 86 (refer to FIGS. 6 and 7), which is so disposed as to extend from the massage mechanism 10 toward the guide rail section 85, is positioned in their respective predetermined areas.

To be more specific, the guide rail section 85 is an endless rail race formed on the opposing inner walls of the lateral plate portions 66 (where the rail portions 53 of the advancing and retracting mechanism 14 are formed) extending forward from the right side and the left side, respectively, of the base member 12. In other words, on the inner wall of the lateral plate portion 66 is formed a recessed opening which is diamond-shaped when viewed from right or left (rhombic opening), and upright side walls of the rhombic opening serve as the guide rail section 85. It is noted that, as described above, the lateral plate portion 66 is formed with the rail portion 53 of the advancing and retracting mechanism 14, too.

Figure 12:
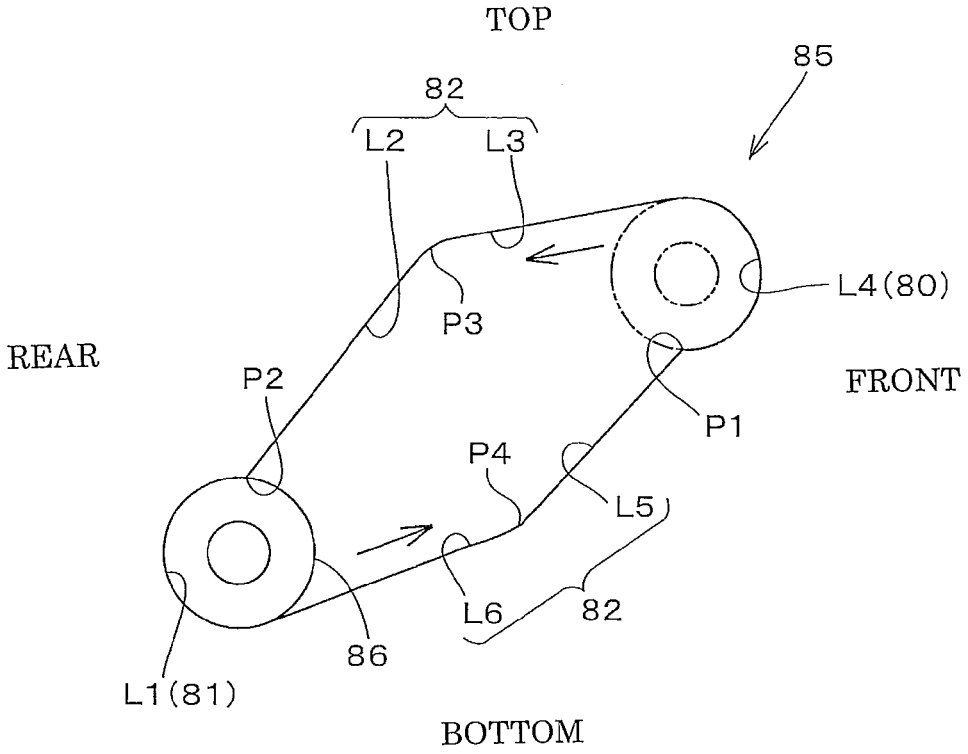
FIG. 12 is a side view of the first embodiment, illustrating the configuration of a rail section constituting a rock restricting mechanism.

As shown in FIG. 12, the guide rail section 85 includes a semicircular part L1 in which the roller-like sliding member 86 can be fitted, a rectilinear part L2 extending obliquely upwardly from the upper end of the semicircular part L1, and a rectilinear part L3 connected to the rectilinear part L2. The rectilinear part L3 has a slope gentler than that of the rectilinear part L2. At an extremity of the rectilinear part L3 opposed to the semicircular part L1 is formed a semicircular part L4 in which the roller-like sliding member 86 can be fitted. The upper end of the semicircular part L4 merges smoothly with the rectilinear part L3.

There are also formed a rectilinear part L5 extending obliquely downwardly from the lower end of the semicircular part L4 and a rectilinear part L6 connected to the rectilinear part L5. The rectilinear part L6 has a slope gentler than that of the rectilinear part L5. Eventually an extremity of the rectilinear part L6 merges smoothly with the lower end of the semicircular part L1. In this way, the loop-like guide rail section 85 is formed.

In such a guide rail section 85, a point of connection P3 between the rectilinear part L2 and the rectilinear part L3, a point of connection between the rectilinear part L3 and the upper end of the semicircular part L4, a point of connection P4 between the rectilinear part L5 and the rectilinear part L6, and a point of connection between the rectilinear part L6 and the lower end of the semicircular part L1 are each defined by a gentle curve. On the other hand, a point of connection P2 between the upper end of the semicircular part L1 and the rectilinear part L2 and a point of connection P1 between the lower end of the semicircular part L4 and the rectilinear part L5 are each defined by an extremal curve so as to be a sharp edge (a sharp point P1, a sharp point P2).

As described previously, the guide rail section 85 takes the form of a rhombic opening when viewed laterally. More specifically, a line connecting the semicircular part L1 with the semicircular part L4 corresponds to the longitudinal axis of the rhombic opening, and the guide rail section 85 is formed in the lateral plate portion 66, with the longitudinal axis pointing in the front-rear direction. That is, the guide rail section 85 is placed radially inwardly from the rail portion 53 of the advancing and retracting mechanism 14 when viewed from the pivot shaft 42 of the rockably pivoting portion 11, with the longitudinal axis of the rhombic opening extending obliquely so as to conform to an arc of a circle about the rockably pivoting portion 11.

The length of the transverse axis of the rhombic opening constituting the guide rail section 85 (a line substantially perpendicular to the longitudinal axis) is substantially one-half that of the longitudinal axis. The transverse axis points in a direction along the guide bar 38 for supporting the tapping motor 32 for free movement in the vertical direction (the direction in which the tapping motor 32 moves closer to and away from the kneading motor 27). The length of the transverse axis of the guide rail section 85 is adjusted to be substantially the same as the distance of vertical movement of the tapping motor 32.

Meanwhile, the sliding member 86 is constructed of a freely rotatable roller formed so as to extend outward from each of the right and left ends of the second rotation shaft 31 in coaxial relation to the second rotation shaft 31. The sliding members 86 are rollable over the right-hand and left-hand guide rail sections 85, respectively, while being fitted in the recess of the rhombic opening.

In the guide rail section 85 whose placement position and opening shape are determined under the aforestated conditions, as shown in FIG. 12, the area thereof corresponding to the semicircular part L4 serves as the first rotation restricting portion 80. Moreover, the semicircular part L1 serves as the second rotation restricting portion 81. The first rotation restricting portion 80 and the second rotation restricting portion 81 are each configured to have an opening width large enough to receive the sliding member 86 securely without causing a backlash.

Moreover, the guide rail section 85 is so shaped that its recessed area becomes larger in width gradually from the first rotation restricting portion 80 to the intersection point P3 in the vertical direction, but becomes smaller in width gradually from the intersection point P3 to the second rotation restricting portion 81 in the vertical direction. Hence it follows that the area between the rectilinear part L3 and the rectilinear part L5, as well as the area between the rectilinear part L2 and the rectilinear part L6, is larger in width than the sliding member 86 in the vertical direction. That is, these areas serve as a space in which the sliding member 86 is able to move freely in the vertical direction. This space constitutes the rotation permitting portion 82.

The operation of such a rock restricting mechanism 15 will be described with reference to FIGS. 1, 2, and 8 through 12.

Figure 8:
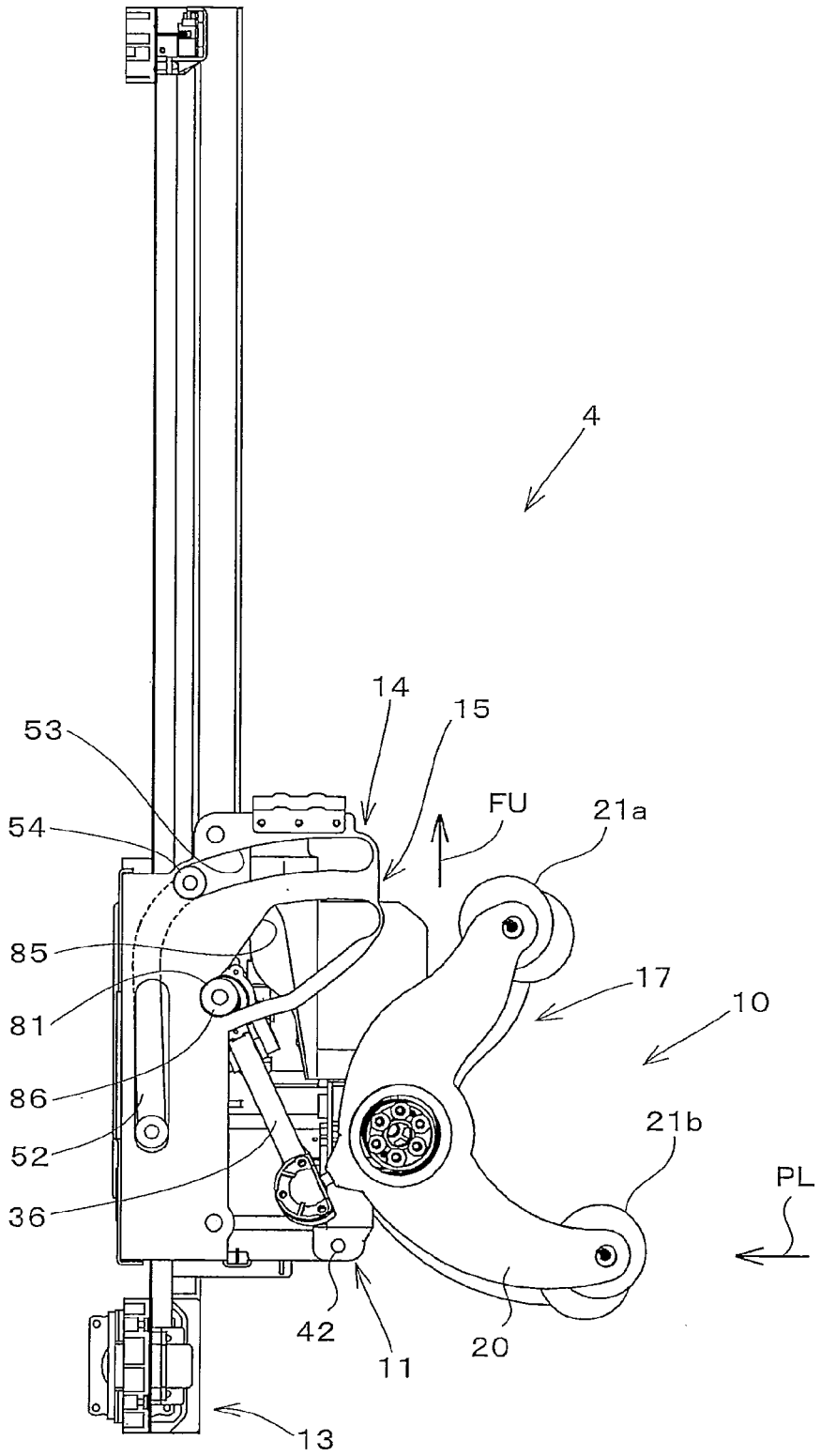
FIG. 8 is a side view of the first embodiment, with parts omitted, illustrating the back kneading device with its massage mechanism brought into a backward-retracted state by the advancing and retracting mechanism while brought to the lower position by the vertical movement mechanism.
Figure 9:
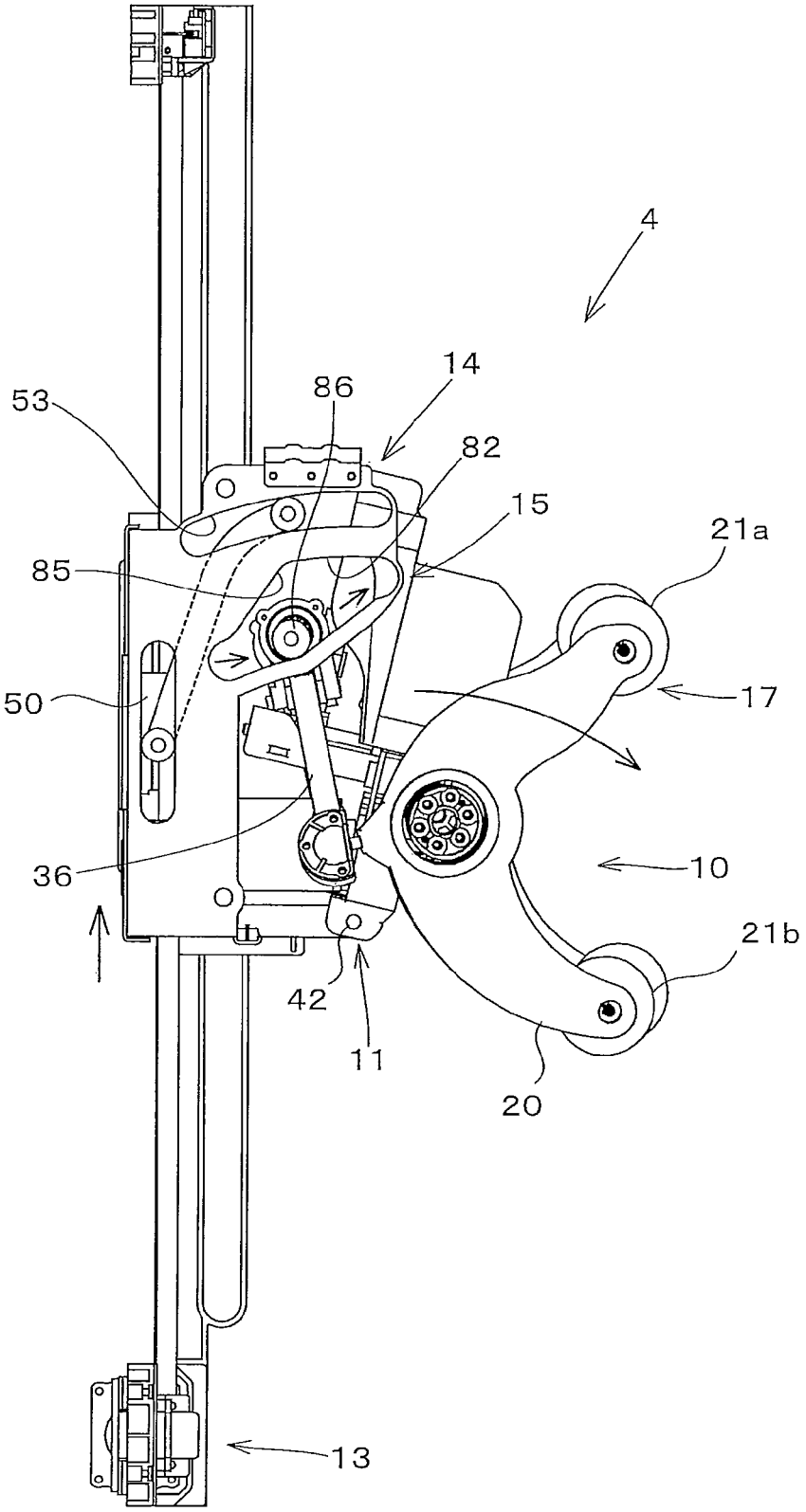
FIG. 9 is a side view of the first embodiment, with parts omitted, illustrating the back kneading device in which the massage mechanism is in the middle of forward advance by the advancing and retracting mechanism while being in the middle of upward movement by the vertical movement mechanism.

In FIG. 8, there is shown a state where the massage mechanism 10 is placed in a lower-end position (the position of the waist of a user) by the vertical movement mechanism 13. In FIG. 9, there is shown a state where the massage mechanism 10 is in the middle of moving upward.

Figure 10:
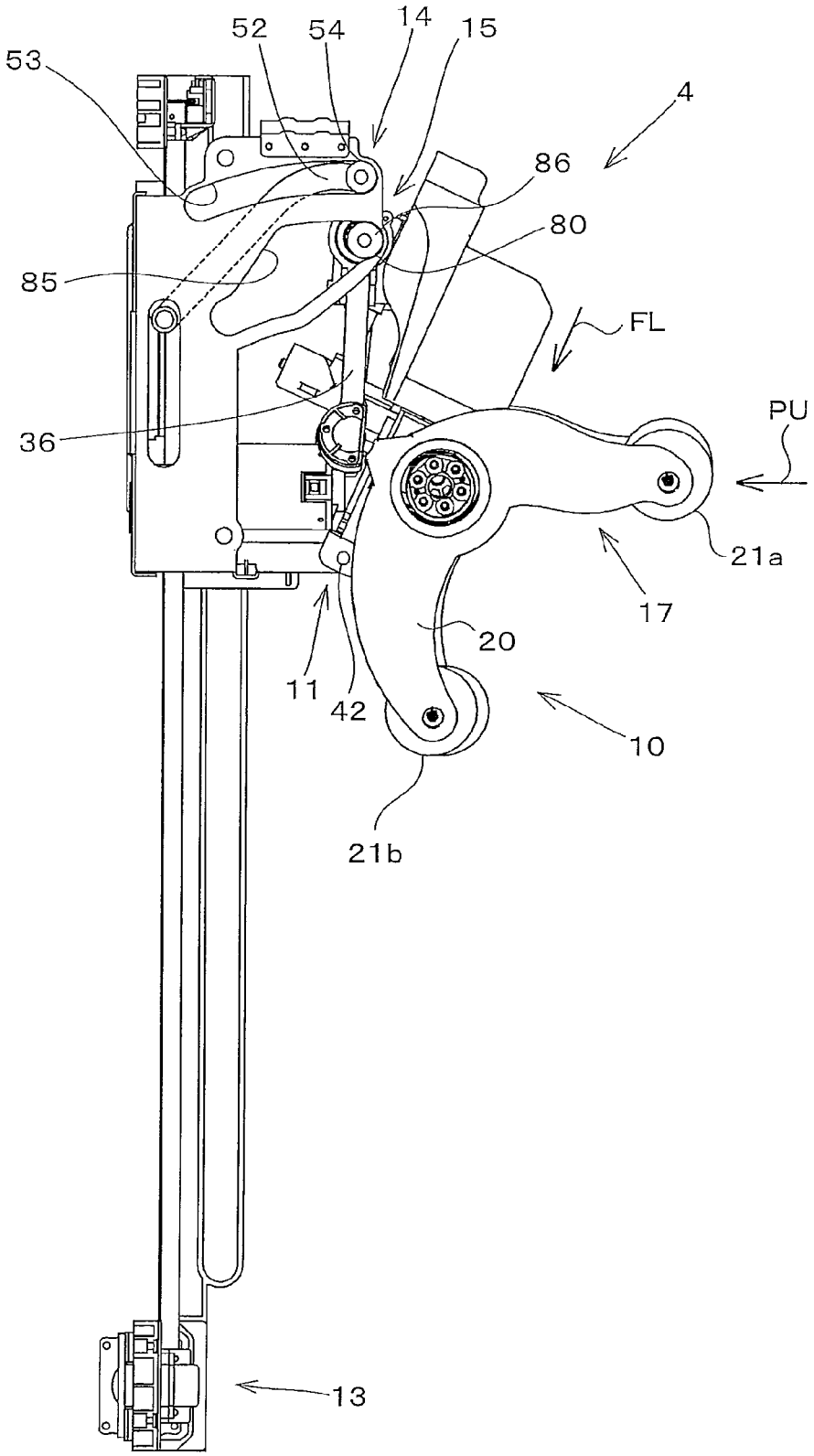
FIG. 10 is a side view of the first embodiment, with parts omitted, illustrating the back kneading device with its massage mechanism brought into a forward-protruding state by the advancing and retracting mechanism while brought to the upper position by the vertical movement mechanism.
Figure 11:
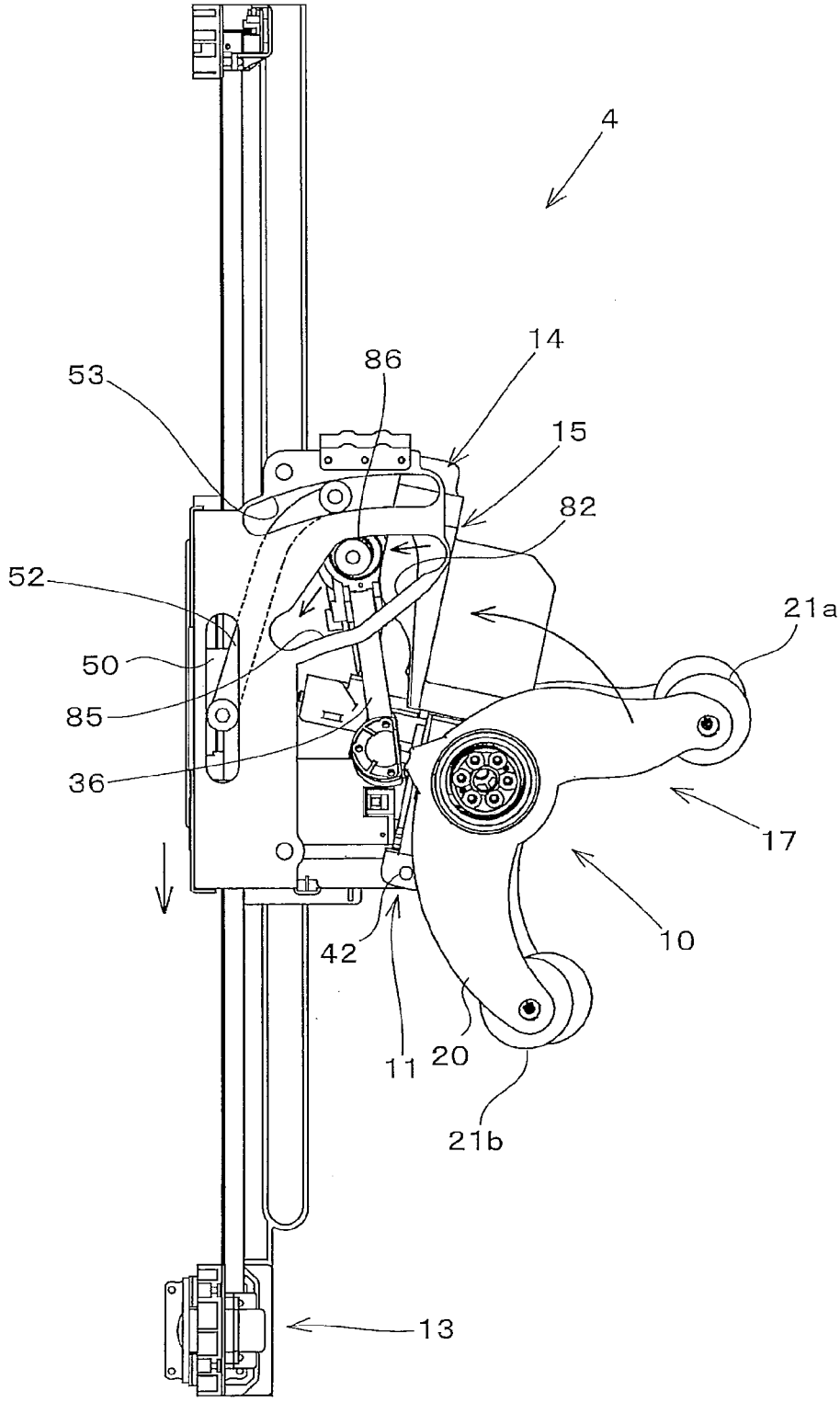
FIG. 11 is a side view of the first embodiment, with parts omitted, illustrating the back kneading device in which the massage mechanism is in the middle of backward retraction by the advancing and retracting mechanism while being in the middle of downward movement by the vertical movement mechanism.

In FIG. 10, there is shown a state where the massage mechanism 10 is moved to come to rest at an upper-end position (the position of the shoulders of a user) by the vertical movement mechanism 13. In FIG. 11, there is shown a state where the massage mechanism 10 is in the middle of moving downward. Following the completion of the movement as shown in FIG. 11, the massage mechanism 10 is brought back to the state shown in FIG. 8.

To begin with, a description will be given as to how the massage mechanism 10 is to be moved upward to reach the position of the shoulders of a user (a transition from the state shown in FIG. 8 to the state shown in FIG. 9, and from there to the state shown in FIG. 10). The following movement can be achieved by controlling the operation of the raising-lowering motor 47 and the electric motor 64 on the basis of a program set in a control section (not represented graphically) provided in the chair-type massage apparatus 1.

Firstly, in the massage mechanism 10 shown in FIG. 8, with a view to giving a massage to the waist of a user, the massage member 17 is maintained with its lower massage element 21*b* jutted forward and its upper massage element 21*a* retracted backward. Being jutted to assume a forwardmost position, the lower massage element 21*b* is able to massage the waist of a user reliably with a high degree of effectiveness.

Under this condition, as the raising-lowering motor 47 of the vertical movement mechanism 13 is caused to run, the screw shaft 48 is rotated with consequent upward movement of the nut member 49 threadedly engaged with the screw shaft 48 and thus upward movement of the base member 12 bearing the nut member 49. Eventually the massage mechanism 10 is allowed to move upward.

As the massage mechanism 10 is moved upward, as shown in FIG. 9, the control section issues a command to the electric motor 64 of the advancing and retracting mechanism 14 in a manner to force the slider 50 to move upward, as well as to force the sliding member 54 slidably fitted in the rail portion 53 to move forward via the transmission arm 52, so that the massage mechanism 10 can be tilted forward about the pivot shaft 42.

In synchronization with the forward tilt of the massage mechanism 10, as shown in FIG. 12, the sliding member 86 of the rock restricting mechanism 15 moves slidingly on the rectilinear part L6 of the guide rail section 85, passes through the midpoint P4 in the guide rail section 85, and moves on the rectilinear part L5 toward the semicircular part L4. At this time, the second rotation shaft 31 bearing the sliding member 86 takes the same path of movement; that is, moves on the rectilinear part L6, passes through the midpoint P4, and passes through the rectilinear part L5 to reach the semicircular part L4, with consequent upward movement of the tapping driving portion 24 (the tapping motor 32). Therefore the link lever 36 is pulled upward, and correspondingly the base end of the support arm 20 is pulled upward, so that the support arm 20 can be rotated about the first rotation shaft 26. Eventually the lower massage element 21*b* is slightly retracted backward and the upper massage element 21*a* is slightly jutted forward.

It is noted that, in the foregoing operation, the sliding member 86 is not moved toward the rectilinear part L2 of the guide rail section 85. This is because there arises a large resistance at the time of getting over the sharp point P2. That is, the sharp point P2 of the guide rail section 85 is an essential constituent element to attain proper workings of the rock restricting mechanism 15.

After that, as shown in FIG. 10, the massage mechanism 10 is moved upward even further. When the massage mechanism 10 reaches the position of the shoulders of a user, the sliding member 86 arrives at the first rotation restricting portion 80 (the semicircular part L4) and is fitted therein. At this time, the tapping driving portion 24 reaches the highest location of the vertical guide support section 41. Under this condition, the link lever 36 is pulled upward to assume an uppermost position, and the support arm 20 is rotated about the first rotation shaft 26. Eventually the lower massage element 21*b* is retracted to assume a rearmost position and the upper massage element 21*a* is jutted to assume a forwardmost position.

Being jutted to assume a forwardmost position, the upper massage element 21*a* is able to massage the shoulders of a user between the top and front regions reliably with a high degree of effectiveness.

Let it be assumed that, under this condition, the upper massage element 21*a* of the massage member 17 is subjected to a leaning load PU (backward pressing force). In this case, it is expected that a rocking motion will be imparted to the massage member 17 to cause it to rotate about the first rotation shaft 26 so that the upper massage element 21*a* is moved backward beyond the lower massage element 21*b*, in consequence whereof there results a downward force FL tending to pull the tapping driving portion 24 downward via the link lever 36. However, since the sliding member 86 of the rock restricting mechanism 15 is securely fitted in the first rotation restricting portion 80 and the resistance of the sharp point P1 exists, it never occurs that the sliding member 86 runs in reverse; that is, moves through the rectilinear part L5 to the midpoint P4 and from there to the rectilinear part L6. In fact, by virtue of the rock restricting mechanism 15, the massage member 17 can be maintained in a state of protruding forward without fail.

Next, a description will be given as to how the massage mechanism 10 is to be retracted backward by the advancing and retracting mechanism 14 (a transition from FIG. 10 to FIG. 11, and from there to FIG. 8). The following movement can also be achieved by controlling the operation of the raising-lowering motor 47 and the electric motor 64 on the basis of a program set in the control section (not represented graphically) provided in the chair-type massage apparatus 1.

Firstly, in the massage mechanism 10 shown in FIG. 10, with a view to giving a massage to the shoulders of a user, the massage member 17 is maintained with its upper massage element 21*a* jutted forward and its lower massage element 21*b* retracted backward.

Under this condition, as the raising-lowering motor 47 of the vertical movement mechanism 13 is caused to run, the screw shaft 48 is rotated in reverse with consequent downward movement of the nut member 49 threadedly engaged with the screw shaft 48 and thus downward movement of the base member 12 bearing the nut member 49. Eventually the massage mechanism 10 is allowed to move downward.

As the massage mechanism 10 is moved downward, as shown in FIG. 11, the control section issues a command to the electric motor 64 of the advancing and retracting mechanism 14 in a manner to force the slider 50 to move downward, as well as to force the sliding member 54 slidably fitted in the rail portion 53 to return backward via the transmission arm 52, so that the massage mechanism 10 can be tilted backward about the pivot shaft 42 (brought into a near-upright state).

In synchronization with the backward tilt of the massage mechanism 10, the sliding member 86 of the rock restricting mechanism 15 moves slidingly on the rectilinear part L3 of the guide rail section 85, passes through the midpoint P3 in the guide rail section 85, and moves on the rectilinear part L2 toward the semicircular part L1. At this time, the second rotation shaft 31 bearing the sliding member 86 takes the same path of movement; that is, moves on the rectilinear part L3, passes through the midpoint P3, and passes through the rectilinear part L2 to reach the semicircular part L1, with consequent downward movement of the tapping driving portion 24 (the tapping motor 32). In consequence the link lever 36 is pressed downward, and correspondingly the base end of the support arm 20 is pressed downward, so that the support arm 20 can be rotated in reverse about the first rotation shaft 26. Eventually the lower massage element 21*b* is slightly jutted forward.

It is noted that the sliding member 86 is not moved toward the rectilinear part L5 of the guide rail section 85. This is because there arises a large resistance at the time of getting over the sharp point P1. That is, the sharp point P1 of the guide rail section 85 is an essential constituent element to attain proper workings of the rock restricting mechanism 15.

After that, as shown in FIG. 8, the massage mechanism 10 is moved downward even further. When the massage mechanism 10 reaches the position of the waist of a user, the sliding member 86 arrives at the second rotation restricting portion 81 (the semicircular part L1) and is fitted therein. At this time, the tapping driving portion 24 reaches the lowest location of the vertical guide support section 41. Under this condition, the link lever 36 is pressed to assume a lowermost position, and the support arm 20 is rotated in reverse. Eventually the lower massage element 21*b* is jutted to assume a forwardmost position and the upper massage element 21*a* is retracted to assume a rearmost position.

Being jutted to assume a forwardmost position, the lower massage element 21*b* is able to massage the waist of a user reliably with a high degree of effectiveness.

Let it be assumed that, under this condition, the lower massage element 21*b* of the massage member 17 is subjected to a leaning load PU (backward pressing force). In this case, it is expected that a rocking motion will be imparted to the massage member 17 to cause it to rotate about the first rotation shaft 26 so that the lower massage element 21*a* is moved backward beyond the upper massage element 21*a*, in consequence whereof there results an upward force FU tending to push the tapping driving portion 24 upward via the link lever 36. However, since the sliding member 86 of the rock restricting mechanism 15 is securely fitted in the second rotation restricting portion 81 and the resistance of the sharp point P2 exists, it never occurs that the sliding member 86 runs in reverse; that is, moves through the rectilinear part L2 to the midpoint P3 and from there to the rectilinear part L3. In fact, by virtue of the rock restricting mechanism 15, the massage member 17 can be maintained in a state of protruding forward without fail.

It is noted that, in the middle of moving the massage mechanism 10 forward or backward by operating the advancing and retracting mechanism 14, the sliding member 86 is moving along the rotation permitting portion 82 in the guide rail section 85. Since the rotation permitting portion 82 is larger in width than the sliding member 86 in the vertical direction, it follows that the sliding member 86 is free to move in the vertical direction (refer to FIGS. 9 and 11).

That is, under these conditions, the second rotation shaft 31 is likewise allowed to move freely in the vertical direction, and correspondingly the tapping driving portion 24 (the tapping motor 32) is free to move vertically along the guide bar 38. Therefore the support arm 20 coupled via the link lever 36 to the tapping driving portion 24 is brought into a freely rotatable state.

Accordingly, even if the leaning load PU or PL (backward pressing force) is placed on the upper massage element 21*a* or the lower massage element 21*b* of the massage member 17, it is possible to impart downward motion and upward motion to the tapping driving portion 24 without any hindrance, and thereby make the most of the capability of the vertical guide support section 41 to, as has already been described, rotate the massage member 17 about the first rotation shaft 26 so as to conform to an S-like curve of the back of a user, so that the massage elements 21 abut on the back at substantially uniform pressure.

Moreover, as has already been described, the sliding member 86 is disposed coaxially with the second rotation shaft 31. In this case, even if the second rotation shaft 31 is rotated with the driving action of the tapping driving portion 24, since the rotation of the second rotation shaft 31 is not an eccentric rotation, it never occurs that the resultant rotational oscillation is transmitted through the sliding member 86 to the guide rail section 85. That is, during the tapping action of the massage member 17, the lateral plate portion 66 formed with the guide rail section 85 and the base member 12 are free from adverse effects such as vibration.

It will be apparent from the foregoing detailed description that, according to the chair-type massage apparatus 1 of the present invention, a user is able to have a kneading massage performed by the kneading driving portion 23 of the massage mechanism 10 and a tapping massage performed by the tapping driving portion 24 thereof through the right-hand and left-hand massage members 17 just by setting the back kneading device 4 in motion after sitting on the seat 2 while leaning at his/her back on the backrest 3.

Moreover, by actuating the advancing and retracting mechanism 14 on an as needed basis in accordance with the body shape of a user, target areas of massage, or the desires of a user, it is possible to cause the massage mechanism 10 (the massage member 17) to protrude forward beyond a normal massage position and return it to the original position.

In the case of actuating the advancing and retracting mechanism 14, when the massage mechanism 10 is caused to protrude forward, the upper end (the upper massage element 21*a*) of the massage member 17 is brought into a forward-protruding state by the rock restricting mechanism 15 and can be maintained in this state even in the presence of the leaning load PU (backward pressing force) exerted by a user.

On the other hand, when the massage mechanism 10 is caused to retract backward, the lower end (the lower massage element 21*b*) of the massage member 17 is brought into a forward-protruding state by the rock restricting mechanism 15 and can be maintained in this state even in the presence of the leaning load PL (backward pressing force) exerted by a user. Accordingly, the apparatus succeeds in providing a massage treatment such as kneading and tapping in localized regions in an on-target manner (in a pinpoint manner) and thus lives up to user's expectations.

Moreover, the advancing and retracting mechanism 14 is not based on the Air system, wherefore it never occurs that air cell's expansion force yields to a leaning load exerted by a user with a consequent forcible return of the massage mechanism 10 to its original position. Accordingly, neither a decrease in finger-pressure force (massage effect) produced by the massage mechanism 10 nor displacement of finger-pressure positions occurs, and needless to say there is no problem with noise resulting from a flow of air, air emission sound, and so forth.

Better still, the advancing and retracting mechanism 14 is not based on the Link system, wherefore there is no need to prepare a long and large screw shaft having a right-hand screw portion and a left-hand screw portion. Accordingly, neither an increase in cost associated with parts count nor an increase in size of the apparatus occurs.

Further, in contrast to the simple conventional Cam system, the transmission arm 52 is provided. This makes it possible to impart a great back-and-forth stroke to the massage mechanism 10. Also, in contrast to the conventional Lever system, the speeding-up of operation can be achieved. Accordingly, in the chair-type massage apparatus 1 as a whole, for example, in the course of a series of massage steps, there arises no possibility that cycle time is uselessly increased.

Second Embodiment

In FIGS. 14 to 20, there is shown a second embodiment of the chair-type massage apparatus equipped with a back kneading device pursuant to the present invention.

The second embodiment is the same as the first embodiment (refer to FIG. 13) in that the chair-type massage apparatus 1 comprises a seat 2 and a backrest 3, that a back kneading device 4 is attached to the backrest 3 interiorly thereof, and that a leg frame 6 is disposed below the seat 2. In addition, the second embodiment is the same as the first embodiment (refer to FIGS. 1 to 7) in that the back kneading device 4 comprises a massage mechanism 10, a base member 12, and a vertical movement mechanism 13, and also includes an advancing and retracting mechanism 14 for changing the angle of inclination of the massage mechanism 10 in a front-rear direction relative to the base member 12, and a rock restricting mechanism 15 for regulating rotation or rocking movement of a massage member 17 disposed in the massage mechanism 10.

It is noted that, for the purpose of explanation of the directions as to the constituent components of the apparatus of the second embodiment, the same definitions as adopted in the first embodiment, such as the vertical direction, the horizontal direction, and the front-rear direction, are used also in the following description.

Figure 14:
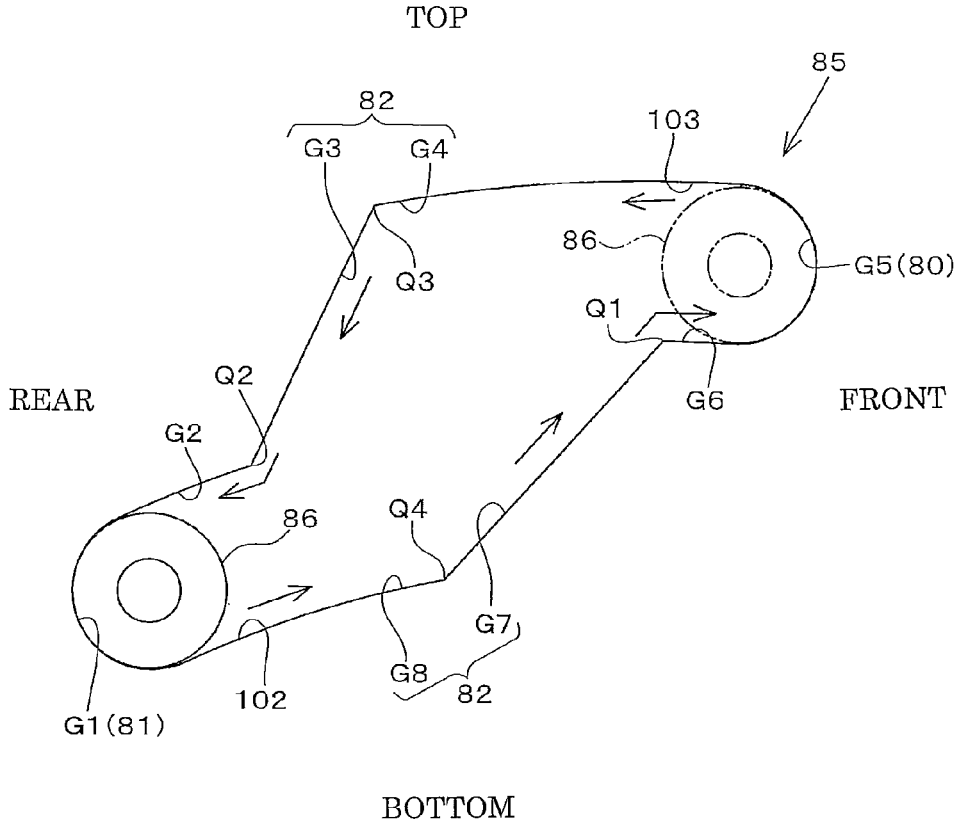
FIG. 14 is a side view of a second embodiment, illustrating the configuration of the rail section constituting the rock restricting mechanism.

As shown in FIG. 14, the most distinct difference of the second embodiment from the first embodiment is that a first protrusion adjustment portion 103 and a second protrusion adjustment portion 102 are provided in a guide rail section 85 disposed in the rock restricting mechanism 15.

The rock restricting mechanism 15 of the second embodiment is substantially the same in structure as that of the first embodiment. That is, the rock restricting mechanism 15 includes a first rotation restricting portion 80, a second rotation restricting portion 81, and a rotation permitting portion 82 for permitting the rotation of the massage member 17 about a first rotation shaft 26, and in which the guide rail section 85 is an endless rail race formed on the opposing inner walls of lateral plate portions 66 extending forward from the right side and the left side, respectively, of the base member 12. In the second embodiment, the guide rail section 85 is characterized by having the first rotation restricting portion 80, the first protrusion adjustment portion 103, the second rotation restricting portion 81, the second protrusion adjustment portion 102, and the rotation permitting portion 82 (that are each assigned a predetermined area of the guide rail section 85).

Firstly, as shown in FIG. 14, the guide rail section 85 has, in its rear lower area, a semicircular part G1 in which a roller-like sliding member 86 can be fitted. There are also formed a rectilinear part G2 extending forward and slightly obliquely upwardly from the upper end of the semicircular part G2, a rectilinear part G3 extending obliquely upwardly from the forward end of the rectilinear part G2 at a larger inclination angle, and a rectilinear part G4 connected to the rectilinear part G3. The rectilinear part G4 has a slope gentler than that of the rectilinear part G3.

The rectilinear part G4 extends forward with a length greater than is required for one side of a rhombus to form a forward extension. At the forward end of the rectilinear part G4 opposed to the semicircular part G1 is formed a semicircular part G5 in which the roller-like sliding member 86 can be fitted. The rectilinear part G4 is connected to the upper end of the semicircular part G5.

There are also formed a rectilinear part G6 extending backward from the lower end of the semicircular part G5 in parallel with the forward extension of the rectilinear part G4, a rectilinear part G7 extending obliquely downwardly from the rear end of the rectilinear part G6, and a rectilinear part G8 connected to the rectilinear part G7. The rectilinear part G8 has a slope gentler than that of the rectilinear part G7.

The rectilinear part G8 having a length required for one side of a rhombus is extended backward even further in parallel with the rectilinear part G2 to form a backward extension. The rear end of the extension is connected to the lower end of the semicircular part G1. Eventually those parts altogether constitute the endless guide rail section 85.

The rear-located semicircular part G1 is configured to receive the sliding member 86, wherefore a region between the rectilinear part G2 and the rectilinear part G8 arranged in parallel with each other correspondingly with the diameter of the semicircular part G1 can be used as a passage for the sliding member 86. Accordingly, the rear-located semicircular part G1 is formed as the second rotation restricting portion 81 acting as an abutment to stop the backward movement of the sliding member 86. Moreover, the rear passage located between the second rotation restricting portion 82 and the rhombic opening (the region between the rectilinear part G2 and the rectilinear part G8) is formed as the second protrusion adjustment portion 102 for permitting the sliding member 86 to slide only in the front-rear direction while being fitted therein.

Likewise, the front-located semicircular part G5 is configured to receive the sliding member 86, wherefore a region between the rectilinear part G4 and the rectilinear part G6 arranged in parallel with each other correspondingly with the diameter of the semicircular part G5 can also be used as a passage for the sliding member 86. Accordingly, the front-located semicircular part G5 is formed as the first rotation restricting portion 80 acting as an abutment to stop the forward movement of the sliding member 86. Moreover, the front passage located between the first rotation restricting portion 80 and the rhombic opening (the region between the rectilinear part G4 and the rectilinear part G6) is formed as the first protrusion adjustment portion 103 for permitting the sliding member 86 to slide only in the front-rear direction while being fitted therein.

A point of connection between the upper end of the semicircular part G1 and the rectilinear part G2, a point of connection between the rectilinear part G4 and the upper end of the semicircular part G5, a point of connection between the lower end of the semicircular part G5 and the rectilinear part G6, and a point of connection between the rectilinear part G8 and the lower end of the semicircular part G1 are each defined by a straight line or a gentle curve.

On the other hand, a point of connection Q2 between the rectilinear part G2 and the rectilinear part G3 and a point of connection Q1 between the rectilinear part G6 and the rectilinear part G7 are each made as a convex intersection, expressed differently, a pointed part (a sharp point Q1, a sharp point Q2) to hinder a shift of the sliding member 86.

It is noted that, as described previously, the guide rail section 85 takes the form of a rhombic opening when viewed laterally. More specifically, a line connecting the second protrusion adjustment portion 102 at the side of the second rotation restricting portion 81 (the semicircular part G1) with the first protrusion adjustment portion 103 at the side of the first rotation restricting portion 80 (the semicircular part G5) corresponds to the longitudinal axis of the rhombic opening, and the guide rail section 85 is formed in the lateral plate portion 66, with the longitudinal axis pointing in the front-rear direction.

The operation of such a rock restricting mechanism 15 will be described with reference to FIGS. 15 through 20.

Figure 15:
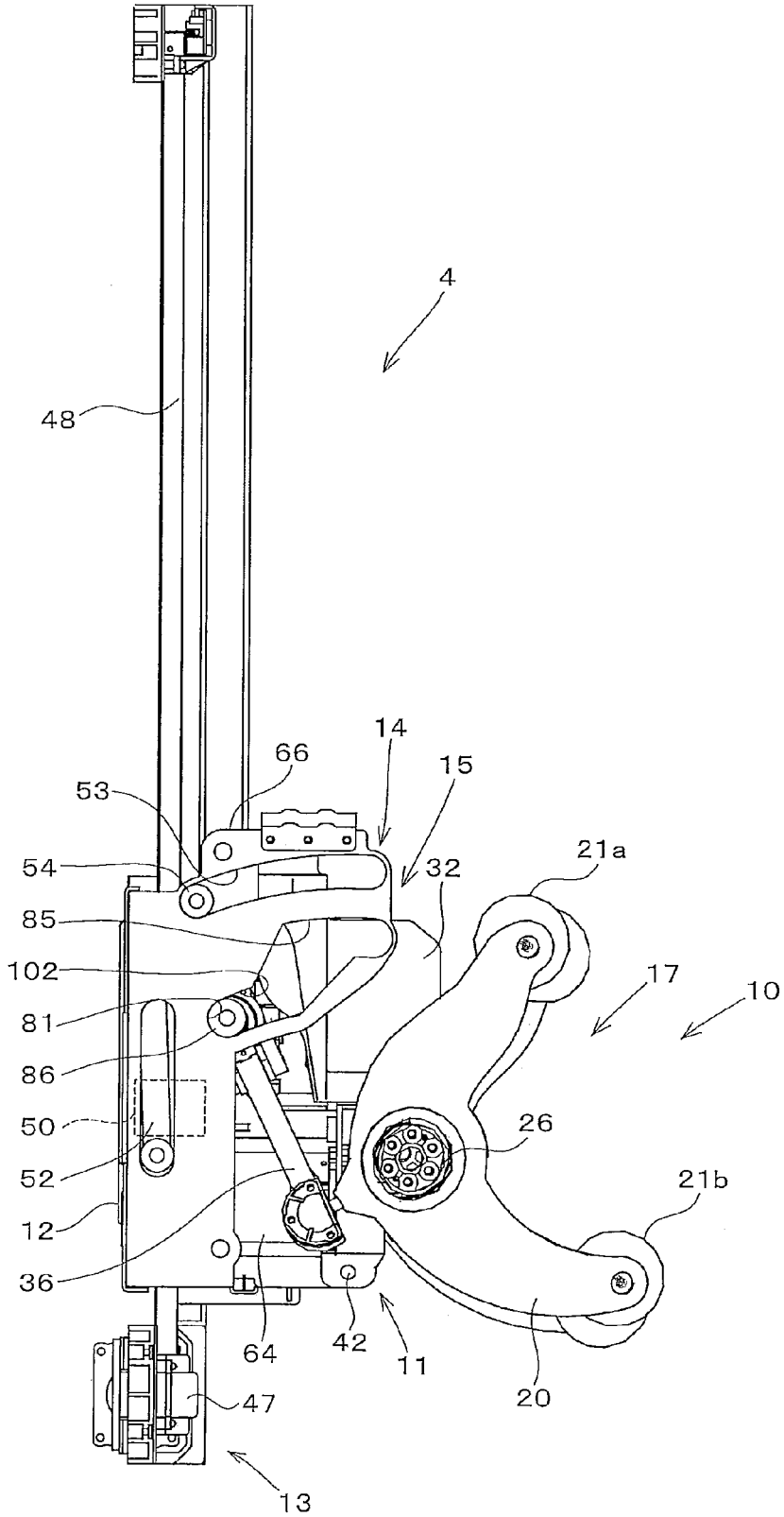
FIG. 15 is a side view of the second embodiment, with parts omitted, illustrating the back kneading device with its massage mechanism brought into a backward-retracted state by the advancing and retracting mechanism while brought to the lower position by the vertical movement mechanism.
Figure 16:
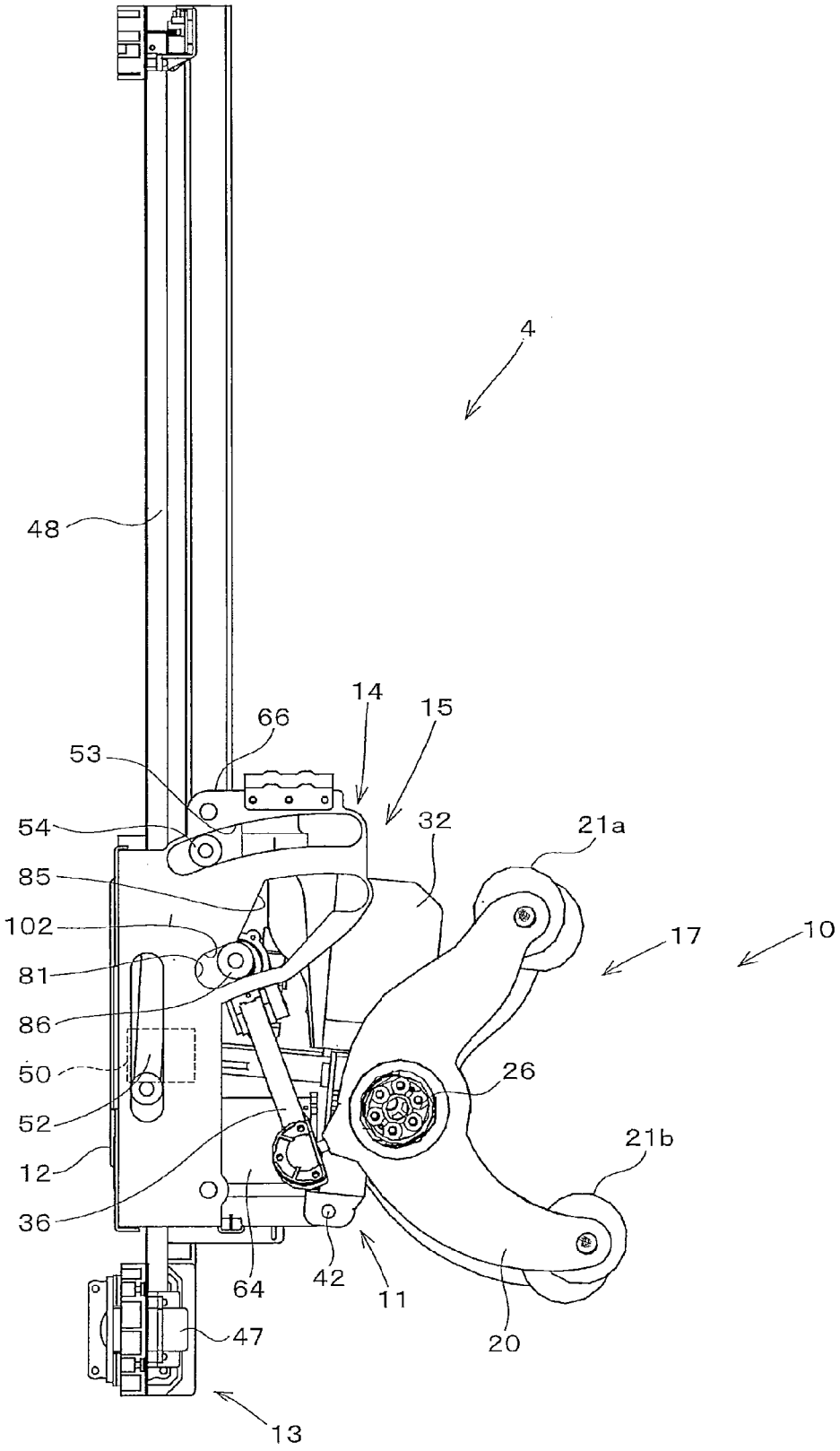
FIG. 16 is a side view of the second embodiment, with parts omitted, illustrating the back kneading device as seen immediately after the massage mechanism, now kept in the lower position by the vertical movement mechanism and in a backward-retracted state by the advancing and retracting mechanism, is moved upward.
Figure 17:
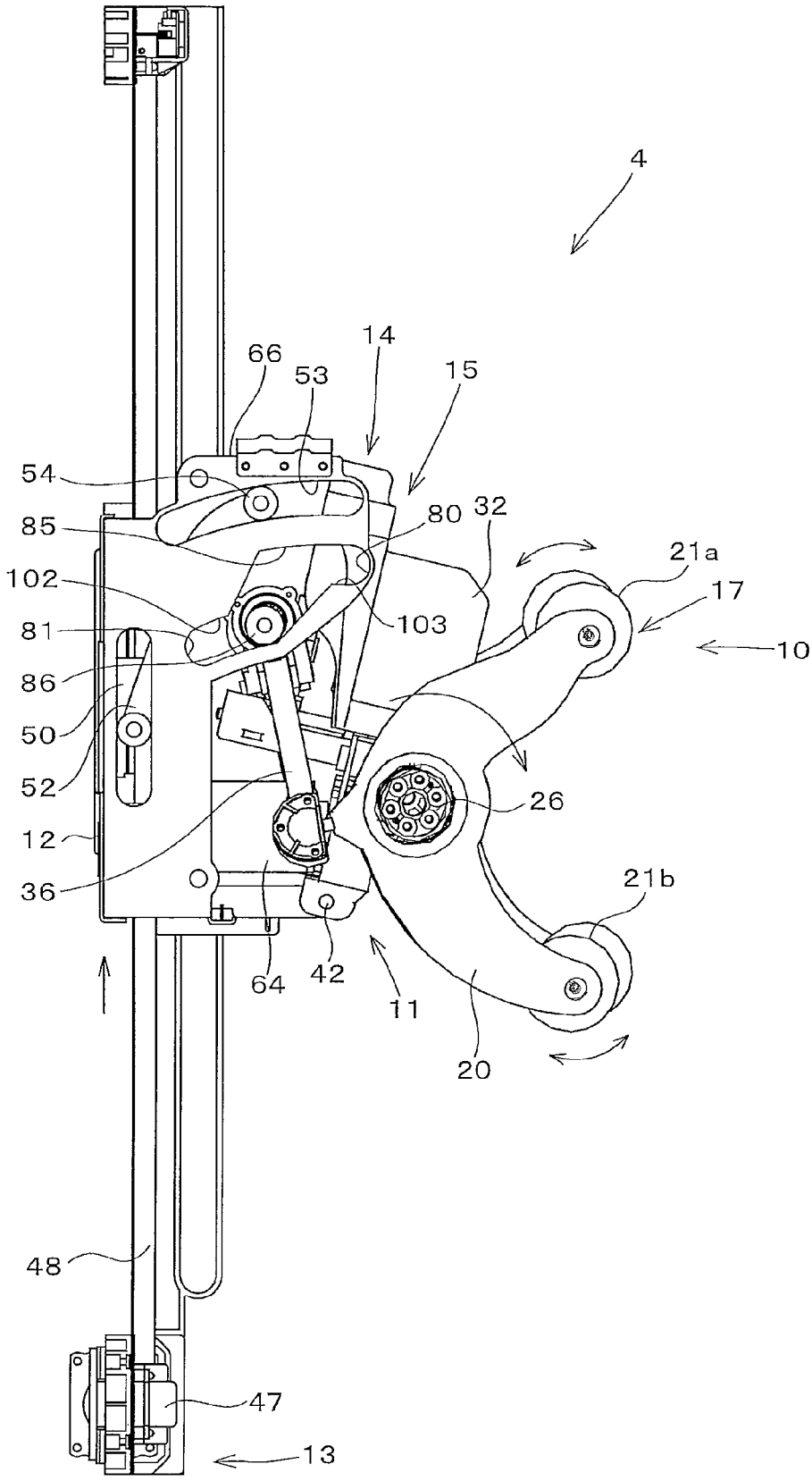
FIG. 17 is a side view of the second embodiment, with parts omitted, illustrating the back kneading device in which the massage mechanism is in the middle of forward advance by the advancing and retracting mechanism while being in the middle of upward movement by the vertical movement mechanism.
Figure 18:
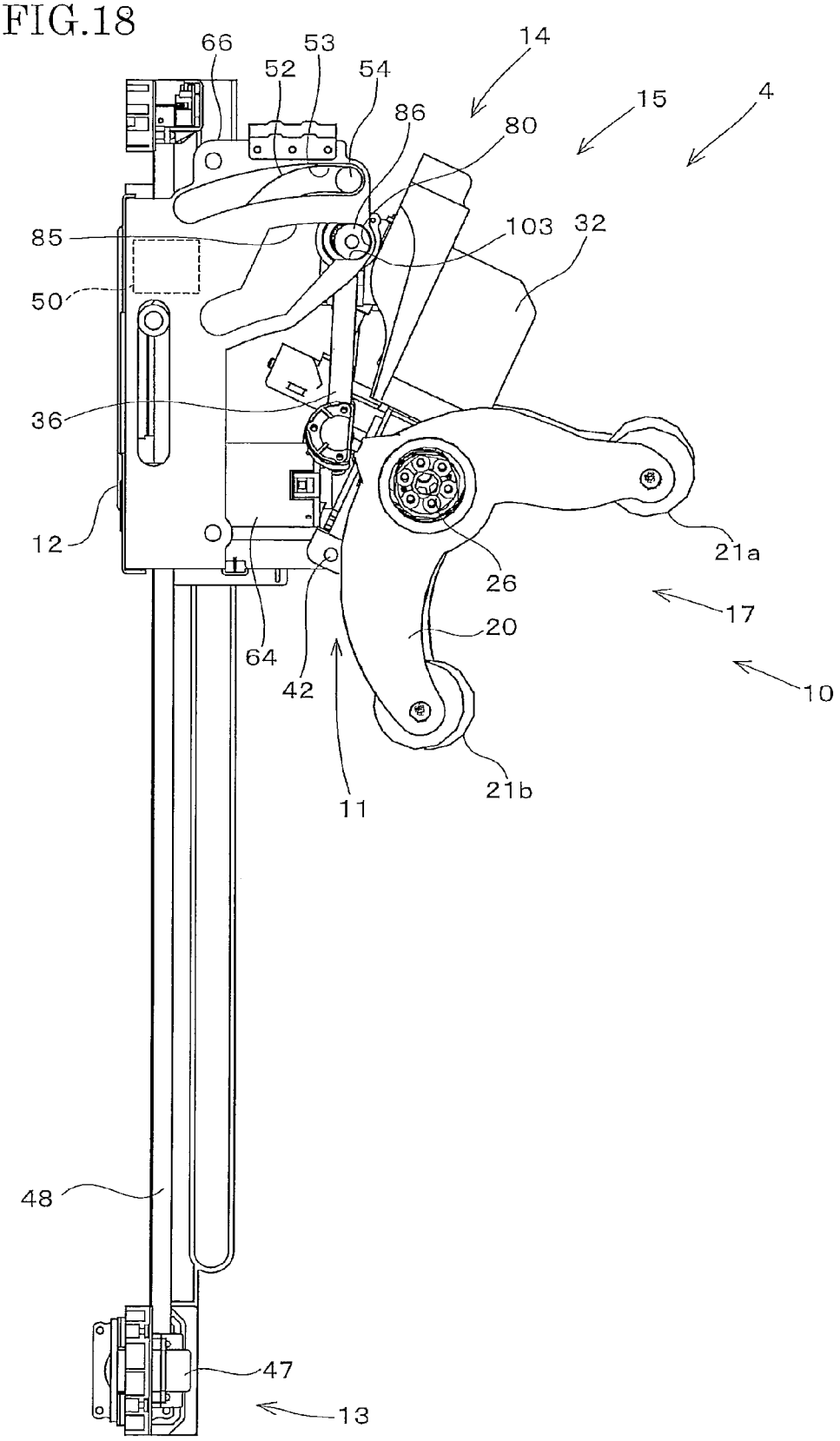
FIG. 18 is a side view of the second embodiment, with parts omitted, illustrating the back kneading device with its massage mechanism brought into a forward-protruding state by the advancing and retracting mechanism while brought to the upper position by the vertical movement mechanism.

In FIG. 15, there is shown a state where the massage mechanism 10 is placed in a lower-end position (the position of the waist of a user) by the vertical movement mechanism 13. In FIG. 16, there is shown a state immediately after the start of upward movement of the massage mechanism 10. In FIG. 17, there is shown a state where the massage mechanism 10 is in the middle of moving upward. In FIG. 18, there is shown a state where the massage mechanism 10 is placed in an upper-end position (the position of the shoulders of a user) by the vertical movement mechanism 13.

Figure 19:
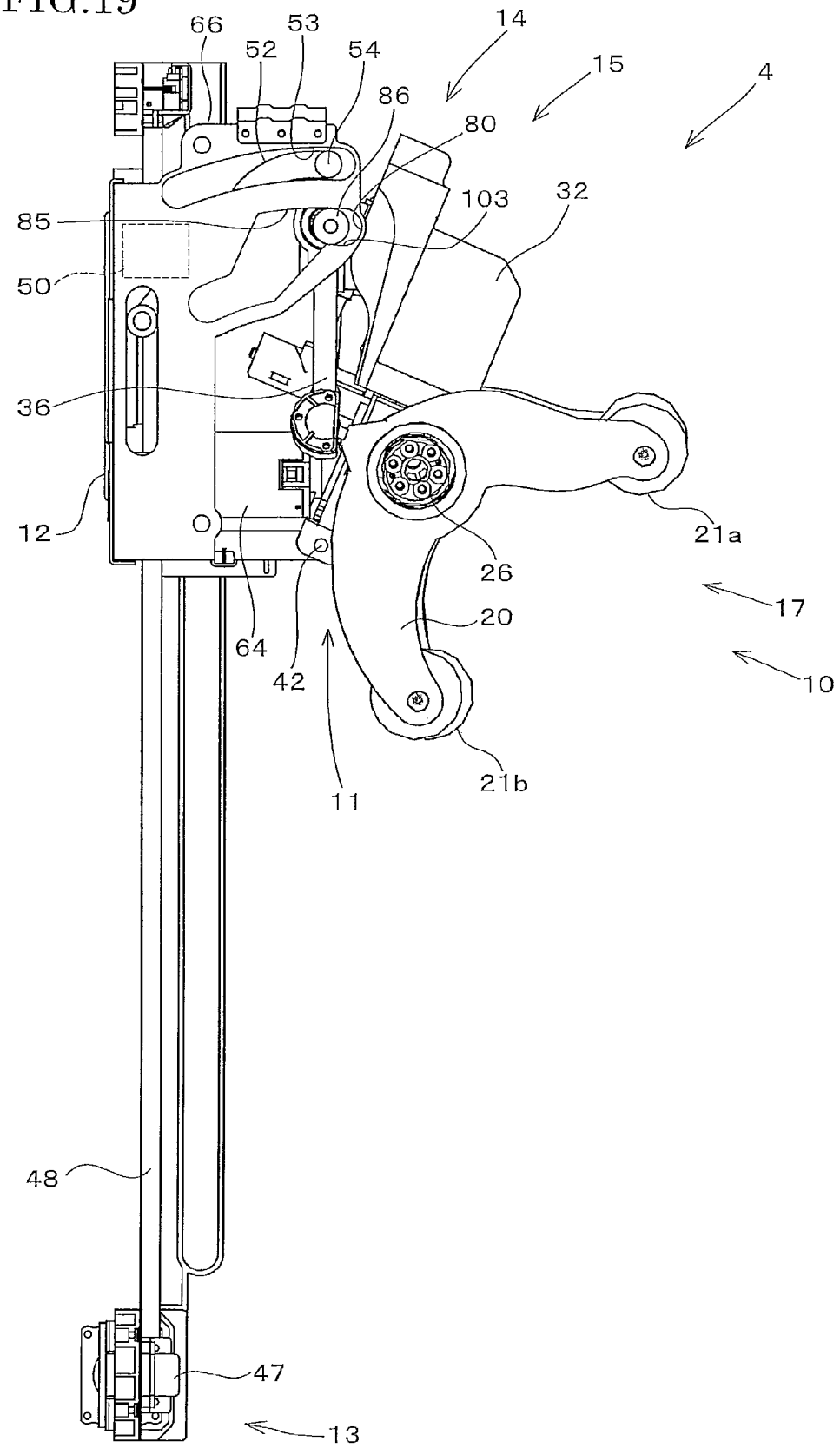
FIG. 19 is a side view of the second embodiment, with parts omitted, illustrating the back kneading device as seen immediately after the massage mechanism, now kept in the upper position by the vertical movement mechanism and in a forward-protruding state by the advancing and retracting mechanism, is moved downward.
Figure 20:
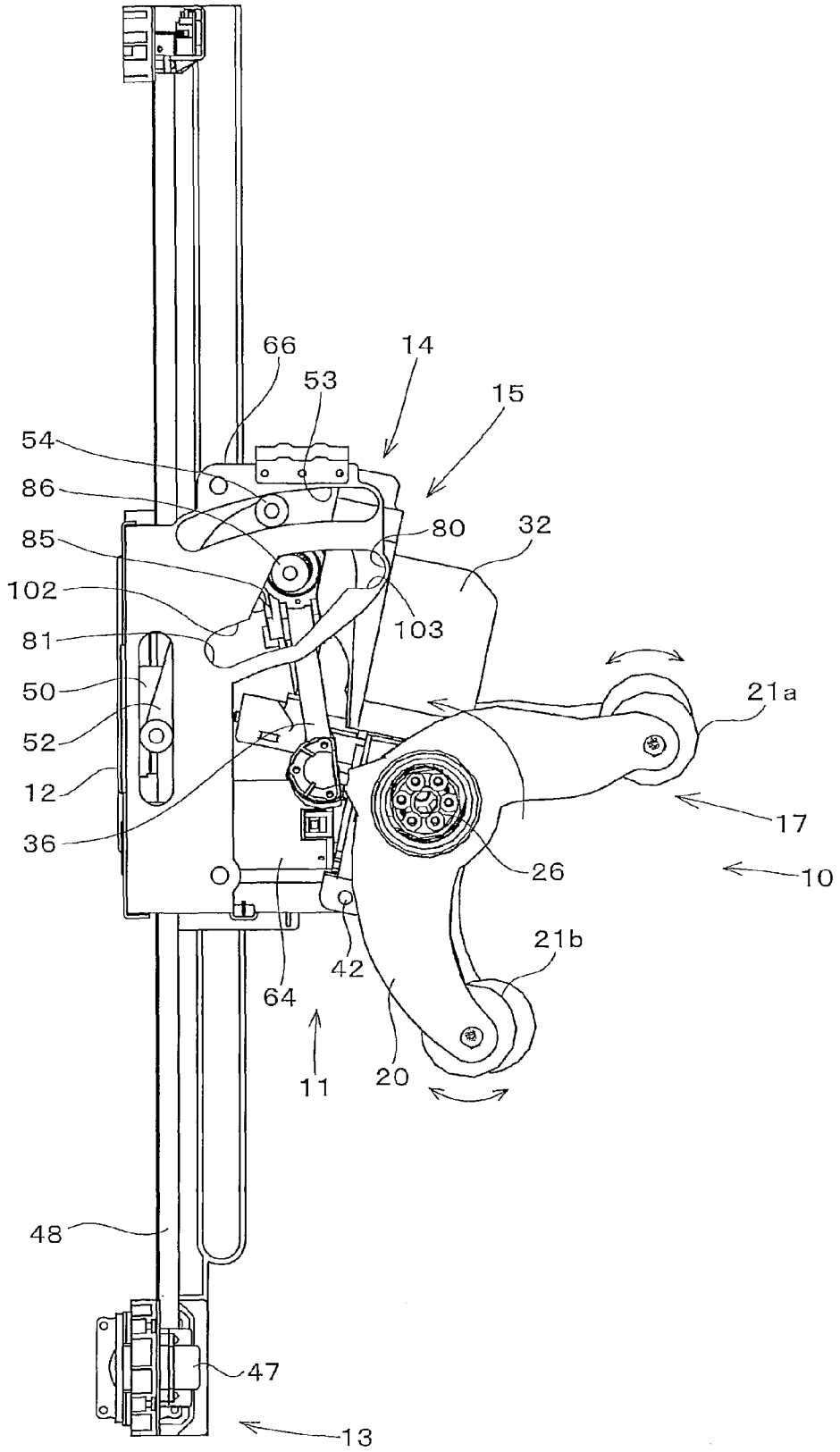
FIG. 20 is a side view of the second embodiment, with parts omitted, illustrating the back kneading device in which the massage mechanism is in the middle of backward retraction by the advancing and retracting mechanism while being in the middle of downward movement by the vertical movement mechanism.

In FIG. 19, there is shown a state immediately after the start of downward movement of the massage mechanism 10. In FIG. 20, there is shown a state where the massage mechanism 10 is in the middle of moving downward. Following the completion of the movement as shown in FIG. 20, the massage mechanism 10 is brought back to the state shown in FIG. 15.

To begin with, a description will be given as to how the massage mechanism 10 is to be moved upward to reach the position of the shoulders of a user (a transition from FIG. 15 to FIG. 16, from there to FIG. 17, and from there to FIG. 18). The following movement can be achieved by controlling the operation of a raising-lowering motor 47 and an electric motor 64 on the basis of a program set in a control section (not represented graphically) provided in the chair-type massage apparatus 1.

Firstly, in the massage mechanism 10 shown in FIG. 15, with a view to giving a massage to the waist of a user, the massage member 17 is maintained with its lower massage element 21*b* jutted forward and its upper massage element 21*a* retracted backward. Being jutted to assume a forwardmost position, the lower massage element 21*b* is able to massage the waist of a user reliably with a high degree of effectiveness.

The control section is programmed to issue a command also to the electric motor 64 of the advancing and retracting mechanism 14 when the raising-lowering motor 47 of the vertical movement mechanism 13 starts to run under the condition as described just above. As the electric motor 64 starts to run, as shown in FIG. 16, the slider 50 is pressed upward, and the sliding member 54 slidably fitted in the rail portion 53 is pressed forward via the transmission arm 52, so that the massage mechanism 10 can be tilted forward about the pivot shaft 42.

As shown in FIG. 14, in synchronization with the start of the forward tilt of the massage mechanism 10, the sliding member 86 of the rock restricting mechanism 15, now in a state of being stopped in abutment with the second rotation restricting portion 81 of the guide rail section 85, travels forward through the second protrusion adjustment portion 102. That is, the sliding member 86 is moved slidingly from the semicircular part G1 to the rectilinear part G8 and travels thereon, and similarly the second rotation shaft 31 (the upper end of the link lever 36) bearing the sliding member 86 is moved forward along the rectilinear part G8, with a consequent forward tilt of the massage mechanism 10.

In accompaniment with such an operation, the support arm 20 is rotated very slightly about the first rotation shaft 26, with the lower massage element 21*b* retracted slightly backward. At this time, the upper massage element 21*a* is jutted slightly forward. This helps decrease the pressing force exerted on the waist of a user by the lower massage element 21*b* (reduce the strength of the force a little). That is, the second protrusion adjustment portion 102 functions as a mechanism for adjusting the pressing force exerted by the lower massage element 21*b* (a pressing-force strength adjustment mechanism).

It is noted that the sliding member 86 is restrained against vertical movement and the second rotation shaft 31 is restrained from being pressed upward so long as the sliding member 86 is fitted in the second protrusion adjustment portion 102. This makes it possible to maintain the forward-protruding state of the lower massage element 21*b* without fail.

As shown in FIG. 17, following the completion of the operation to reduce the strength of the waist pressing force exerted by the lower massage element 21*b*, the massage mechanism 10 is moved upward even further to reach the position of the back of a user.

The massage mechanism 10 is continuously tilted forward while being moved upward, and correspondingly the sliding member 86 of the rock restricting mechanism 15 slides on the rectilinear part G8 of the guide rail section 85, passes through a midpoint Q4 in the guide rail section 85, and slides on the rectilinear part G7 forwardly upwardly.

At this time, the second rotation shaft 31 bearing the sliding member 86 takes the same path of movement; that is, travels on the rectilinear part G8, passes through the midpoint P4, and travels on the rectilinear part G7. In accompaniment with such a movement, the tapping driving portion 24 (the tapping motor 32) is moved upward with the link lever 36 pulled upward. Correspondingly, the base end of the support arm 20 is pulled upward, so that the support arm 20 can be rotated about the first rotation shaft 26. In consequence the lower massage element 21*b* is retracted backward and the upper massage element 21*a* is jutted forward.

It is noted that, in the foregoing operation, the sliding member 86 is not moved from the rectilinear part G2 of the guide rail section 85 toward the rectilinear part G3 through the sharp point Q2. This is because there arises a large resistance at the time of getting over the sharp point Q2. That is, the sharp point Q2 of the guide rail section 85 is an essential constituent element to attain proper workings of the rock restricting mechanism 15.

Moreover, when the sliding member 86 travels on the rectilinear part G8 and the rectilinear part G7 of the guide rail section 85, since the distance from the rectilinear part G8, G7 to the opposite side thereof, viz., the rectilinear part G4, G3 is greater than the outside diameter of the sliding member 86 thereby constituting the rotation permitting portion 82, it follows that the sliding member 86 is allowed to move up and down in the rotation permitting portion 82 and correspondingly the second rotation shaft 31 moves up and down. As a result, it becomes possible to make the most of the capability of the vertical guide support section 41 to rotate the massage member 17 about the first rotation shaft 26 repeatedly so as to conform to an S-like curve of the back of a user while moving the massage mechanism 10 upward, so that the massage elements 21 abut on the back at substantially uniform pressure.

After that, as shown in FIG. 18, the massage mechanism 10 is moved upward even further. When the massage mechanism 10 reaches the position of the shoulders of a user, in the guide rail section 85, the sliding member 86 arrives at the first rotation restricting portion 80, viz., the semicircular part G5 and is stopped in abutment therewith after passing through the rectilinear part G7 and the sharp point Q1 and then moving forward while being fitted in the region between the rectilinear part G4 and the rectilinear part G6, viz., the first protrusion adjustment portion 103. At this time, the upper massage element 21*a* is jutted to assume a forwardmost position and is thus able to massage the shoulders of a user between the top and front regions reliably with a high degree of effectiveness.

Next, a description will be given as to how the massage mechanism 10 is to be retracted backward by the advancing and retracting mechanism 14 (a transition from FIG. 18 to FIG. 19, from there to FIG. 20, and from there to FIG. 15). The following movement can also be achieved by controlling the operation of the raising-lowering motor 47 and the electric motor 64 on the basis of a program set in the control section (not represented graphically) provided in the chair-type massage apparatus 1.

The control section is programmed to issue a command also to the electric motor 64 of the advancing and retracting mechanism 14 when the raising-lowering motor 47 of the vertical movement mechanism 13 starts to run under the above-described condition shown in FIG. 18. As the electric motor 64 starts to run, as shown in FIG. 19, the slider 50 is pulled downward, and the sliding member 54 slidably fitted in the rail portion 53 is pulled backward via the transmission arm 52, so that the massage mechanism 10 can be tilted backward about the pivot shaft 42 (brought into a near-upright state).

As shown in FIGS. 19 and 14, in synchronization with the start of the backward tilt of the massage mechanism 10, the sliding member 86 of the rock restricting mechanism 15, now in a state of being stopped in abutment with the first rotation restricting portion 80 of the guide rail section 85, travels backward through the first protrusion adjustment portion 103. That is, the sliding member 86 is moved slidingly from the semicircular part G2 to the rectilinear part G4 and travels thereon, and similarly the second rotation shaft 31 (the upper end of the link lever 36) bearing the sliding member 86 is moved backward along the rectilinear part G4, with a consequent backward tilt of the massage mechanism 10.

In accompaniment with such an operation, the support arm 20 is rotated very slightly about the first rotation shaft 26, with the upper massage element 21*a* retracted slightly backward. At this time, the lower massage element 21*b* is jutted slightly forward. This helps decrease the pressing force exerted on the shoulders of a user by the upper massage element 21*a* (reduce the strength of the force a little). That is, the first protrusion adjustment portion 103 functions as a mechanism for adjusting the pressing force exerted by the upper massage element 21*a* (a pressing-force strength adjustment mechanism).

It is noted that the sliding member 86 is allowed to move only in the front-rear direction (restrained against vertical movement) and the second rotation shaft 31 is restrained from being pulled downward so long as the sliding member 86 is fitted in the first protrusion adjustment portion 103.

After that, as shown in FIG. 20, the massage mechanism 10 is continuously tilted backward while being moved downward, and correspondingly the sliding member 86 of the rock restricting mechanism 15 slides on the rectilinear part G4 of the guide rail section 85, passes through a midpoint Q3 in the guide rail section 85, and slides on the rectilinear part G3 backwardly downwardly.

At this time, the second rotation shaft 31 bearing the sliding member 86 takes the same path of movement; that is, travels on the rectilinear part G4, passes through the midpoint Q3, and travels on the rectilinear part G3. In accompaniment with such a movement, the tapping driving portion 24 (the tapping motor 32) is moved downward with the link lever 36 forced to return downward. Correspondingly, the base end of the support arm 20 is pressed downward, so that the support arm 20 is rotated in reverse about the first rotation shaft 26. In consequence the upper massage element 21*a* is retracted backward and the lower massage element 21*b* is jutted forward.

It is noted that, in the foregoing operation, the sliding member 86 is not moved from the rectilinear part G6 of the guide rail section 85 toward the rectilinear part G7 through the sharp point Q1. This is because there arises a large resistance at the time of getting over the sharp point Q1. That is, the sharp point Q1 of the guide rail section 85 is an essential constituent element to attain proper workings of the rock restricting mechanism 15.

Moreover, as to the travel of the sliding member 86 on the rectilinear part G4 and the rectilinear part G3 of the guide rail section 85, the distance from the rectilinear part G4, G3 to the opposite side thereof, viz., the rectilinear part G8, G7 is greater than the outside diameter of the sliding member 86 thereby constituting the rotation permitting portion 82.

Therefore, during this travel, the sliding member 86 is allowed to move up and down in the rotation permitting portion 82. As a result, it becomes possible to make the most of the capability of the vertical guide support section 41 to rotate the massage member 17 about the first rotation shaft 26 repeatedly so as to conform to an S-like curve of the back of a user while moving the massage mechanism 10 downward, so that the massage elements 21 abut on the back at substantially uniform pressure.

After that, the massage mechanism 10 is changed to the state shown in FIG. 15.

It should be understood that the embodiments as set forth hereinabove are considered in all respects as illustrative only and not restrictive. The scope of the present invention is indicated by the appended claims rather than the foregoing description, and all changes that come within the meaning of and the range of equivalency of the claims are intended to be embraced therein.

For example, there is no particular limitation to the details of the structure of the chair-type massage apparatus 1 in itself (other than the basic structure comprising the seat 2 and the backrest 3), as well as to the details of the structure of the massage mechanism 10.

Moreover, the chair-type massage apparatus 1 may be provided with a "body-part detection sensor" constructed of a photoelectric sensor or the like device, which is attached to the backrest 3 interiorly thereof. In this case, for example, the position of the shoulders of a user is detected by this sensor. On the basis of the detected user's shoulder position, the apparatus is controlled in such a manner that, at the user's shoulder position, the upper-end part of the massage mechanism 10 (the upper massage element 21*a*) is jutted forward, whereas, at a user's waist position (a location spaced downward from the shoulder position by a predetermined distance), the upper-end part of the massage mechanism 10 (the upper massage element 21*a*) is retracted backward. It is advisable that such a control operation is effected by the control section provided in the chair-type massage apparatus 1.

EXPLANATION OF REFERENCE SYMBOLS

1 Chair-type massage apparatus
2 Seat
3 Backrest
4 Back kneading device
10 Massage mechanism
11 Rockably pivoting portion
12 Base member
13 Vertical movement mechanism
14 Advancing and retracting mechanism
17 Massage member
18 Driving section
50 Slider
51 Slide mechanism
52 Transmission arm
53 Rail portion
54 Sliding member
63 Motor
65 Internal thread portion
67 Pivot shaft (First pivot shaft)
68 Link coupling portion
70 Link coupling portion
80 First rotation restricting portion
81 Second rotation restricting portion
82 Rotation permitting portion
85 Guide rail section
86 Sliding member
102 Second protrusion adjustment portion
103 First protrusion adjustment portion

The invention claimed is:

1. A back kneading device mounted in a chair massage apparatus so as to be located in a backrest of the chair massage apparatus, the back kneading device comprising:

a massage mechanism including a pair of right-hand and left-hand massage members each having treatment elements disposed at an upper end and a lower end thereof, respectively, and a driving section for transmitting a massage motion to the massage members;

a base member for retaining said massage mechanism for free back-and-forth rocking movement while supporting a lower-end part of the massage mechanism at a rockably pivoting portion;

a vertical movement mechanism for allowing the base member to move in a vertical direction in said backrest;

an advancing and retracting mechanism for advancing and retracting an upper-end part of said massage mechanism in a front-rear direction relative to said base member; and a rock restricting mechanism capable of holding the upper end of said massage member in a forward-protruding state when the upper-end part of the massage mechanism is caused to protrude forward by said advancing and retracting mechanism;

wherein said massage mechanism is provided with a kneading driving portion which comprises a first rotation shaft installed in alignment with a horizontal direction, the massage members disposed for free rotation relative to the first rotation shaft, and a swing preventive mechanism engaged with said massage member for restraining said massage member from rotating dependently with a rotation of the first rotation shaft, for producing a kneading action by moving the massage members closer to and away from each other through a driving rotation of the first rotation shaft, wherein said massage mechanism is also provided with a tapping driving portion which is coupled to said swing preventive mechanism and produces a tapping action by advancing and retracting the massage member in the front-rear direction through a to-and-fro rocking movement of a support arm about the first rotation shaft via the swing preventive mechanism, said tapping driving portion including a second rotation shaft disposed in parallel with the first rotation shaft, an eccentric driver eccentrically mounted with respect to the second rotation shaft, and a long crankshaft which has its one end coupled for reception of an eccentric rotation from said eccentric driver and has the other end coupled to said swing preventive mechanism, and is moved reciprocally in a lengthwise direction through the eccentric rotation from said eccentric driver, wherein said tapping driving portion is free to move in a direction perpendicular to the first rotation shaft and the vertical direction, and, as said tapping driving portion is moved up and down, said crankshaft is moved up and down correspondingly, thereby allowing said massage member to rotate about the first rotation shaft, wherein said rock restricting mechanism includes a sliding member disposed at both ends of the second rotation shaft provided in said tapping driving portion coaxially with the second rotation shaft, and an endless guide rail section in which the sliding member is slidingly moved, and wherein, in said guide rail section, there is formed a first rotation restricting portion in which said sliding member is fitted when the upper-end part of said massage mechanism is caused to protrude forward, thereby restricting an angle of rotation of said massage member so that the upper end of said massage member can be kept in a forward-protruding state.

2. The back kneading device mounted in a chair massage apparatus according to claim 1, wherein said rock restricting mechanism is configured to be able to hold the lower end of said massage member in a forward-protruding state when the upper-end part of the massage mechanism is caused to retract backward by said advancing and retracting mechanism.

3. The back kneading device mounted in a chair massage apparatus according to claim 1, wherein, in said guide rail section, there is formed a second rotation restricting portion in which said sliding member is fitted when the upper-end part of said massage mechanism is caused to retract backward, thereby restricting an angle of rotation of said massage member so that the lower end of said massage member can be kept in a forward-protruding state.

4. The back kneading device mounted in a chair massage apparatus according to claim 3, wherein, in said guide rail section, there is formed a rotation permitting portion for allowing the massage member to rotate about said first rotation shaft by permitting vertical movement of said sliding member.

5. The back kneading device mounted in a chair massage apparatus according to claim 4, wherein said guide rail section is defined by a periphery of an opening which is diamond-shaped when viewed laterally, said opening having a longitudinal axis pointing in the front-rear direction and a transverse axis, which is substantially perpendicular to the longitudinal axis of said opening, pointing in the vertical direction, and wherein, at each of opposite edges of the opening located at a front end and a rear end, respectively, of said longitudinal axis, there is formed a semicircular part in which the sliding member can be fitted, and the front-located semicircular part constitutes the first rotation restricting portion, the rear-located semicircular part constitutes the second rotation restricting portion, and a space along said transverse axis constitutes the rotation permitting portion.

6. A chair massage apparatus comprising:

a seat; and a backrest which is disposed at the rear of the seat and has the built-in back kneading device as set forth in claim 5.

7. The back kneading device mounted in a chair type chair massage apparatus according to claim 4, wherein said guide rail section is defined by a periphery of an opening which is diamond-shaped when viewed laterally, said opening having a longitudinal axis pointing in the front-rear direction and a transverse axis, which is substantially perpendicular to the longitudinal axis of said opening, pointing in the vertical direction, and wherein, at each of opposite edges of the opening located at a front end and a rear end, respectively, of said longitudinal axis, there are formed a back-and-forth passage through which the sliding member is allowed to slide only in the front-rear direction while being fitted therein and a semicircular part serving as a far end of the back-and-forth passage, and the front-located semicircular part constitutes the first rotation restricting portion, the front-located passage lying between the first rotation restricting portion and said opening constitutes a first protrusion adjustment portion, the rear-located semicircular part constitutes the second rotation restricting portion, the rear-located passage lying between the second rotation restricting portion and said opening constitutes a second protrusion adjustment portion, and a space along said transverse axis constitutes the rotation permitting portion.

8. A chair massage apparatus comprising:

a seat; and a backrest which is disposed at the rear of the seat and has the built-in back kneading device as set forth in claim 7.

9. The back kneading device mounted in a chair massage apparatus according to claim 1, wherein said advancing and retracting mechanism comprises a slider disposed for free vertical movement with respect to said base member, a slide mechanism for imparting vertical motion to the slider, a transmission arm pivotally supported for free rotation with respect to the upper-end part of said massage mechanism and said slider, for coupling said slider and the massage mechanism, a rail portion formed so as to extend forward from said base member along a lateral side of the massage mechanism, and a sliding member formed so as to extend from said massage mechanism toward the rail portion for free movement along said rail portion.

10. The back kneading device mounted in a chair massage apparatus according to claim 9, wherein said rail portion is defined by an upwardly curved arc whose center coincides with said rockably pivoting portion.

11. The back kneading device mounted in a chair massage apparatus according to claim 9, wherein a position of placement of the sliding member with respect to said massage mechanism and a pivot shaft on which said transmission arm is pivotally supported by the massage mechanism are arranged coaxially with each other on an axis of the pivot shaft.

12. The back kneading device mounted in a chair massage apparatus according to claim 9, wherein said slide mechanism comprises an internal thread portion formed in said slider so as to pass therethrough in the vertical direction, a feed screw shaft threadedly engaged with the internal thread portion, and an electric motor for rotatably driving the feed screw shaft.

* * * * *